US008879931B2

(12) United States Patent
Kawakami

(10) Patent No.: US 8,879,931 B2
(45) Date of Patent: Nov. 4, 2014

(54) IMAGE FORMING APPARATUS

(75) Inventor: Shinya Kawakami, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 148 days.

(21) Appl. No.: 13/542,239

(22) Filed: Jul. 5, 2012

(65) Prior Publication Data

US 2013/0016983 A1 Jan. 17, 2013

(30) Foreign Application Priority Data

Jul. 11, 2011 (JP) ..... 2011-152573

(51) Int. Cl.
*G03G 15/00* (2006.01)

(52) U.S. Cl.
USPC ..... 399/38; 399/162; 399/165

(58) Field of Classification Search
USPC ..... 399/38, 42, 130, 159, 162–165, 397, 399/302, 303, 308, 394, 395
See application file for complete search history.

(56) References Cited

U.S. PATENT DOCUMENTS 6,185,394 B1 * 2/2001 Lee ..... 399/116
6,445,895 B2 * 9/2002 Shirasawa et al. ..... 399/116
6,871,036 B2 * 3/2005 Asuwa et al. ..... 399/302
2011/0194879 A1 8/2011 Nomura et al.
2012/0207494 A1 8/2012 Tomura et al.

FOREIGN PATENT DOCUMENTS

JP 2007-164086 A 6/2007
JP 2008-145680 A 6/2008

* cited by examiner

*Primary Examiner* — Hoan Tran

(74) *Attorney, Agent, or Firm* — Fitzpatrick, Cella, Harper & Scinto

(57) ABSTRACT

An image forming apparatus includes an image bearing member; an endless belt; a first driver for driving the belt in contact to an inner surface of the belt; a second driver for driving the belt in contact to an outer surface of the belt; and a tension detector for detecting a state of tension of the belt. The tension detector includes: a movable device, contacted to the belt in a region downstream of the second driver and upstream of the first driver and in a region upstream of the second driver and downstream of the first driver with respect to a rotational direction of the belt, capable of moving its position depending on the tension of the belt in the two regions; a member-to-be-detected capable of changing its position in interrelation with the movement of the movable device; and a detecting device for detecting the member-to-be-detected.

16 Claims, 10 Drawing Sheets

(a)

(b)

(c)

IMAGE FORMING APPARATUS

FIELD OF THE INVENTION AND RELATED ART

The present invention relates to an image forming apparatus in which a toner image formed on an image bearing member by an electrophotographic recording process or the like is transferred onto a recording material to be recorded.

In an electrophotographic full-color image forming apparatus, toner images formed on photosensitive drums as the image bearing member are transferred onto an intermediary transfer member at a primary transfer portion. Then, the toner images of a plurality of colors superposed on the intermediary transfer member are collectively transferred onto the recording material such as paper at a secondary transfer portion. A product (image forming apparatus) employing such an intermediary transfer type has been commercialized. With respect to the intermediary transfer type, there are many constitutions in which an intermediary transfer belt which is an endless belt is employed as the intermediary transfer member and the secondary transfer portion is formed by the intermediary transfer belt and a secondary transfer roller, and the secondary transfer roller is driven by a motor in order to stably convey the paper (recording material) at the secondary transfer portion.

A schematic structure of the transfer portions in the image forming apparatus of such an intermediary transfer type will be described.

The intermediary transfer belt is, e.g., stretched by a plurality of stretching rollers contacted to an inner peripheral surface of the intermediary transfer belt. One of the stretching rollers has also the function as a driving roller for driving the intermediary transfer belt. The secondary transfer roller is provided at a position where it opposes, via the intermediary transfer belt, the stretching roller different from the driving roller. The secondary transfer roller is contacted to an outer peripheral surface of the intermediary transfer belt and is driven by a driving source different from a driving source of the driving roller.

The recording material is nip-conveyed by the secondary transfer roller and the intermediary transfer belt at the secondary transfer portion, where the toner images formed (transferred) on the intermediary transfer belt at the primary transfer portions for Y (yellow), M (magenta), C (cyan) and K (black) are transferred at the secondary transfer portion.

In the above constitution, the intermediary transfer belt receives a driving force at each of different positions by the driving roller and the secondary transfer roller, respectively. Further, a state in which the recording material and the toner are not present at the secondary transfer portion is a state in which a frictional force of the secondary transfer roller with respect to the intermediary transfer belt is highest and also is a state in which a driving force applied from the secondary transfer roller to the intermediary transfer belt is highest.

In a state in which the frictional force between the intermediary transfer belt and the secondary transfer roller, there can be a slight difference between a rotational speed of the intermediary transfer belt by the driving roller and a rotational speed of the intermediary transfer belt by the secondary transfer roller.

In this case, the intermediary transfer belt causes a fluctuation in tension (tension fluctuation) at each of positions upstream and downstream of the secondary transfer portion. Here, the term "upstream" of the secondary transfer portion refers to a region ranging from a position of the intermediary transfer belt downstream of the driving roller to a position of the intermediary transfer belt upstream of the secondary transfer portion with respect to a rotational direction of the intermediary transfer belt. Further, "downstream" of the secondary transfer portion refers to a region ranging from a position of the intermediary transfer belt downstream of the secondary transfer portion to the primary transfer portion with respect to the rotational direction of the intermediary transfer belt. That is, at each of the positions upstream and downstream of the secondary transfer portion, a tension state of the intermediary transfer belt becomes non-uniform.

In the state in which the tension is non-uniform, when the recording material and the toner image enter the secondary transfer portion and when an image density during the secondary transfer is abruptly switched from a low image density to a high image density, an abrupt friction change is generated between the intermediary transfer belt and the secondary transfer roller.

Due to this friction change, the intermediary transfer belt causes an instantaneous tension fluctuation and expansion and contraction of the intermediary transfer belt with respect to a direction in which the non-uniformity of the tension is eliminated, thus causing a speed fluctuation. This speed fluctuation results in a difference in time when a predetermined position of the intermediary transfer belt reaches each of the primary transfer portions for Y, M, C and K. As a result, positions of the respective color toner images transferred on the intermediary transfer belt are deviated from one another with respect to a sub-scan direction (the rotational direction of the intermediary transfer belt). This deviation is referred to as a color misregistration.

As a result, an image defect such as blur of a character or density non-uniformity is generated.

Further, at the same time, due to the instantaneous tension fluctuation from the tension non-uniformity state of the intermediary transfer belt, an image blur during the primary transfer and an image blur during the secondary transfer (hereinafter referred to as "transfer deviation (blur)") are generated.

In order to solve these problems, Japanese Laid-Open Patent Application (JP-A) 2007-164086 proposes a constitution in which the secondary transfer roller contacted to the intermediary transfer belt at a position different from a position of the driving roller is provided with a means, such as an encoder, for detecting the rotational speed of the secondary transfer roller and on the basis of a detection value of the rotational speed detecting means, rotation control of the driving roller is effected.

Further, JP-A 2008-145680 proposes a constitution in which a member for applying tension to the intermediary transfer belt in contact to the intermediary transfer belt is fixedly provided in an image forming apparatus and is used for detecting the tension at a portion of the intermediary transfer belt and on the basis of its detection result, a speed of the driving roller which dominantly controls the speed of the intermediary transfer belt and a speed of a member opposing the driving roller are controlled.

However, a driving force applied from the secondary transfer roller to the intermediary transfer belt with respect to a tangential direction at a secondary transfer portion between the secondary transfer roller and the intermediary transfer belt is changed in real time depending on thickness and surface property of the recording material passing through the secondary transfer portion, and an amount of the toner image and the like. Further, depending on a charge in diameter of each of rollers due to thermal expansion, thermal contraction, abrasion (wearing) and the like, each of the rotational speeds of the intermediary transfer belt by the secondary transfer roller and the driving roller is also changed.

In the constitution of JP-A 2007-164086, the intermediary transfer belt cannot follow these changes and as a result, the speed of the intermediary transfer belt is fluctuated, thus leaving a problem such that occurrence of the color misregistration and the transfer deviation cannot be completely suppressed.

On the other hand, in the constitution of JP-A 2008-145680, in the case where a load fluctuation is generated at the secondary transfer portion of the intermediary transfer belt, a position change amount of the intermediary transfer belt with elastic deformation of a contact member contacted to the intermediary transfer belt to apply the tension to the intermediary transfer belt is detected. Then, on the basis of its detection result, the speed of the driving roller for the intermediary transfer belt is controlled, so that a degree of the tension fluctuation is intended to be decreased.

However, in the constitution of JP-A 2008-145680, also in a state in which the load fluctuation is not generated in the intermediary transfer belt, the contact member is elastically deformed under large tension of the intermediary transfer belt. In this state, it is very difficult to accurately detect a slight tension fluctuation of the intermediary transfer belt by an amount of the elastic deformation of the contact member.

For example, in the case where the tension of the intermediary transfer belt is further increased from that in an ideal tension state of the intermediary transfer belt, in order to detect the tension fluctuation, there is a need to further deform the contact member more than the contact member in the ideal state. However, with the slight tension fluctuation of the intermediary transfer belt, the contact member cannot be deformed to the extent that the change amount is detectable with reliability. Therefore, the constitution of JP-A 2008-145680 is accompanied with a problem such that only a tension fluctuation of a certain large degree can be detected with reliability.

Further, in the above constitution, detecting sensitivity in a tension-decreased side (tension-relieved side) is higher than that in a tension-increased side (toner(-applied) side). However, in the case where vibration during steady-state movement of the intermediary transfer belt or application and relief of the tension are repeated, the intermediary transfer belt cannot follow such parameters, with the result that a large error is generated and thus the constitution is accompanied with a problem that the tension fluctuation cannot be completely suppressed.

SUMMARY OF THE INVENTION

A principal object of the present invention is to provide an image forming apparatus capable of detecting a fluctuation of tension of an intermediary transfer belt with respect to both directions of tension application and tension relief.

According to an aspect of the present invention, there is provided an image forming apparatus comprising: an image bearing member for bearing a toner image; a rotatable endless belt; a first driving member for rotationally driving the endless belt in contact to an inner peripheral surface of the endless belt; a second driving member for rotationally driving the endless belt in contact to an outer peripheral surface of the endless belt; and a tension detecting unit for detecting a state of tension of the endless belt; wherein the tension detecting unit comprises: a movable device, contacted to the endless belt in a region downstream of the second driving member and upstream of the first driving member and in a region upstream of the second driving member and downstream of the first driving member with respect to a rotational direction of the endless belt, capable of moving its position depending on the tension of the endless belt in the two regions; a member to be detected capable of changing its position in interrelation with the movement of the movable device; and a detecting device for detecting the member to be detected.

These and other objects, features and advantages of the present invention will become more apparent upon a consideration of the following description of the preferred embodiments of the present invention taken in conjunction with the accompanying drawings.

Figure 2:
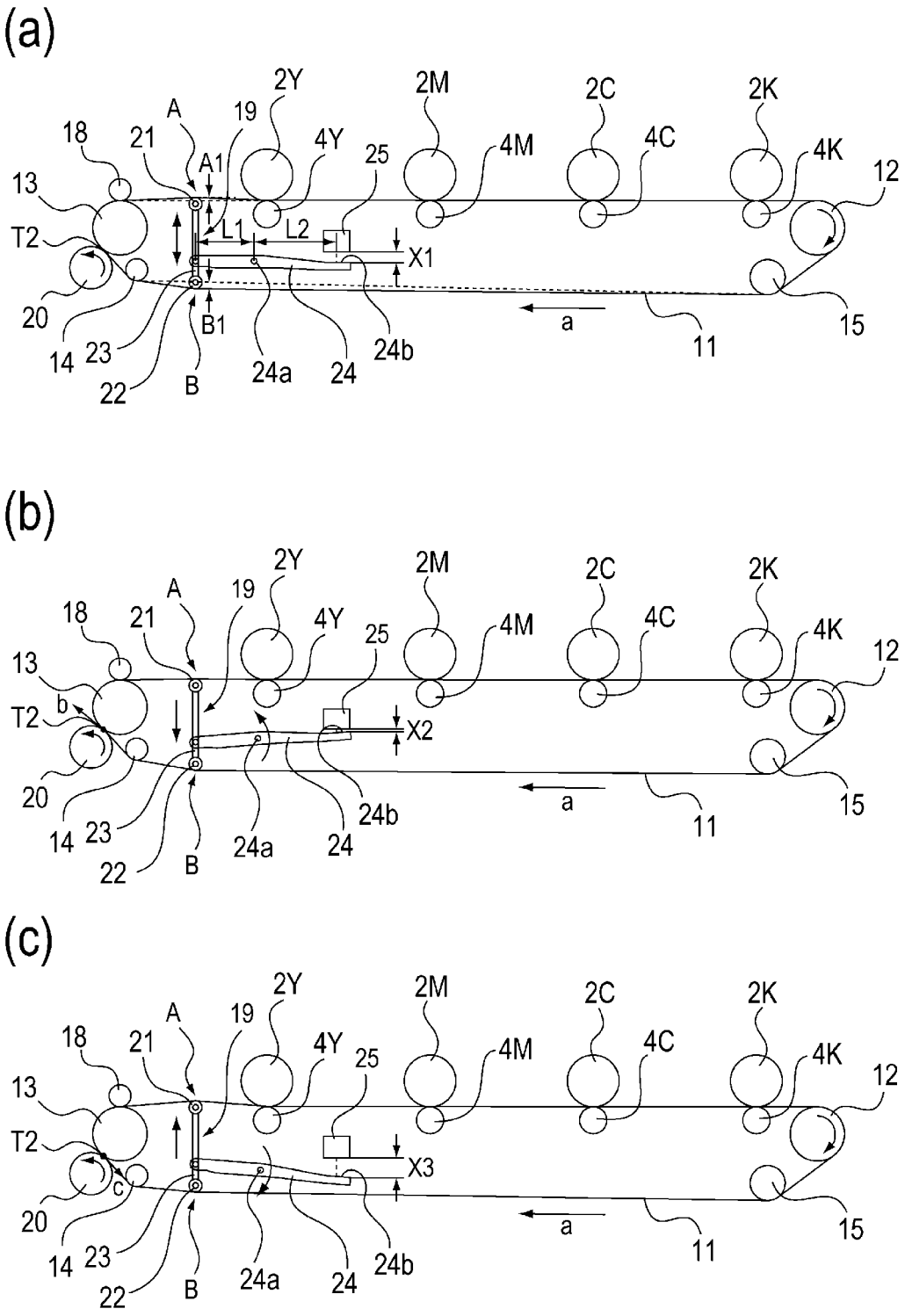

Parts (*a*) to (*c*) of FIG. 2 are schematic sectional views for illustrating an operation of a tension detecting means in the First Embodiment.

Figure 3:
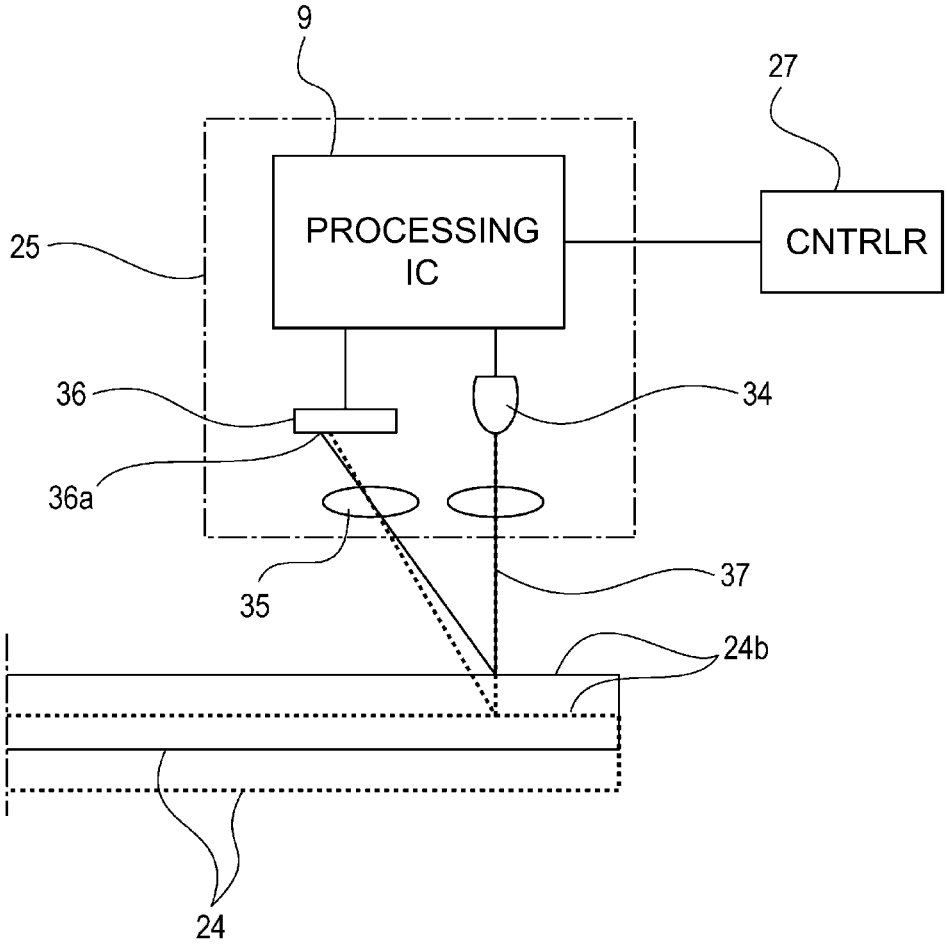

FIG. 3 is a schematic illustration of an optical distance measuring sensor constituting the tension detecting means.

Figure 4:
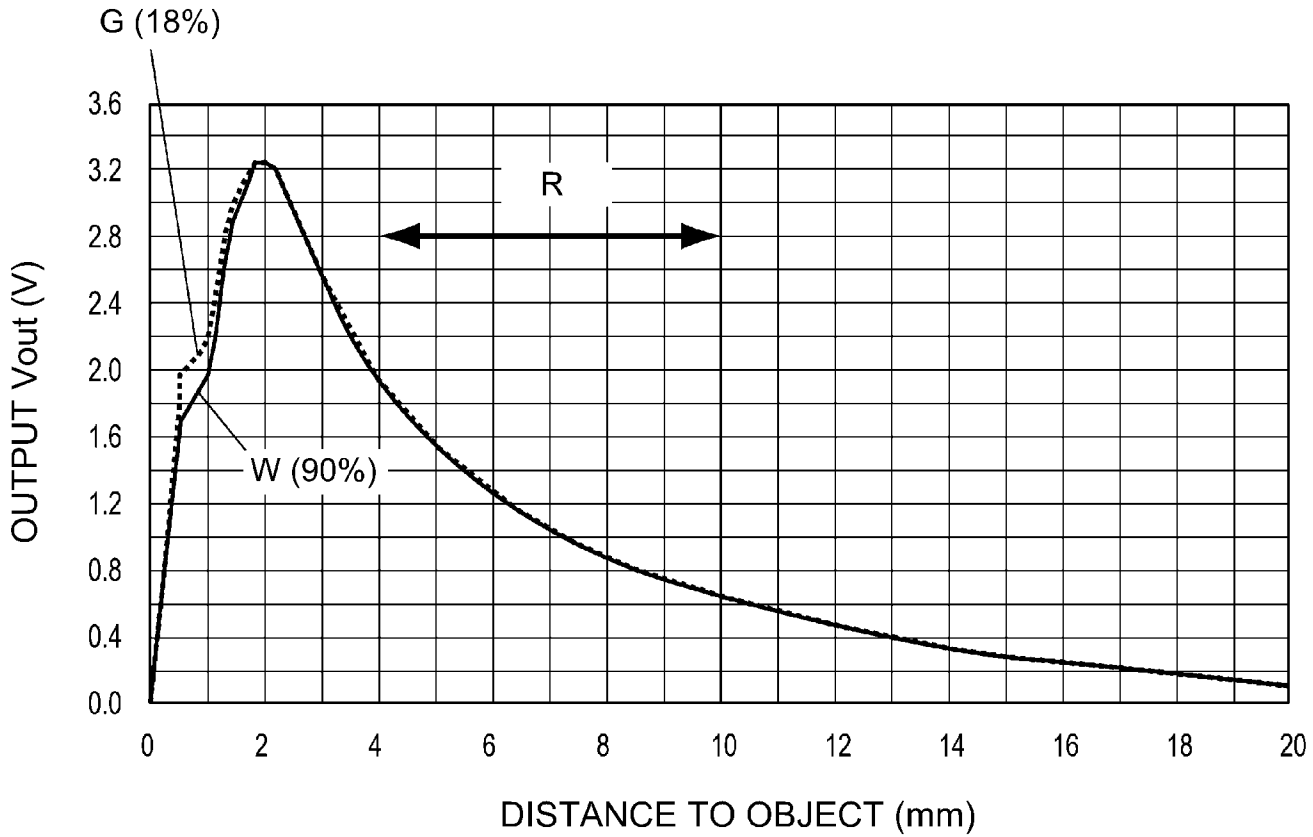

FIG. 4 is a graph showing a relationship between an output voltage of the optical distance measuring sensor and a distance to an object to be detected.

Figure 5:
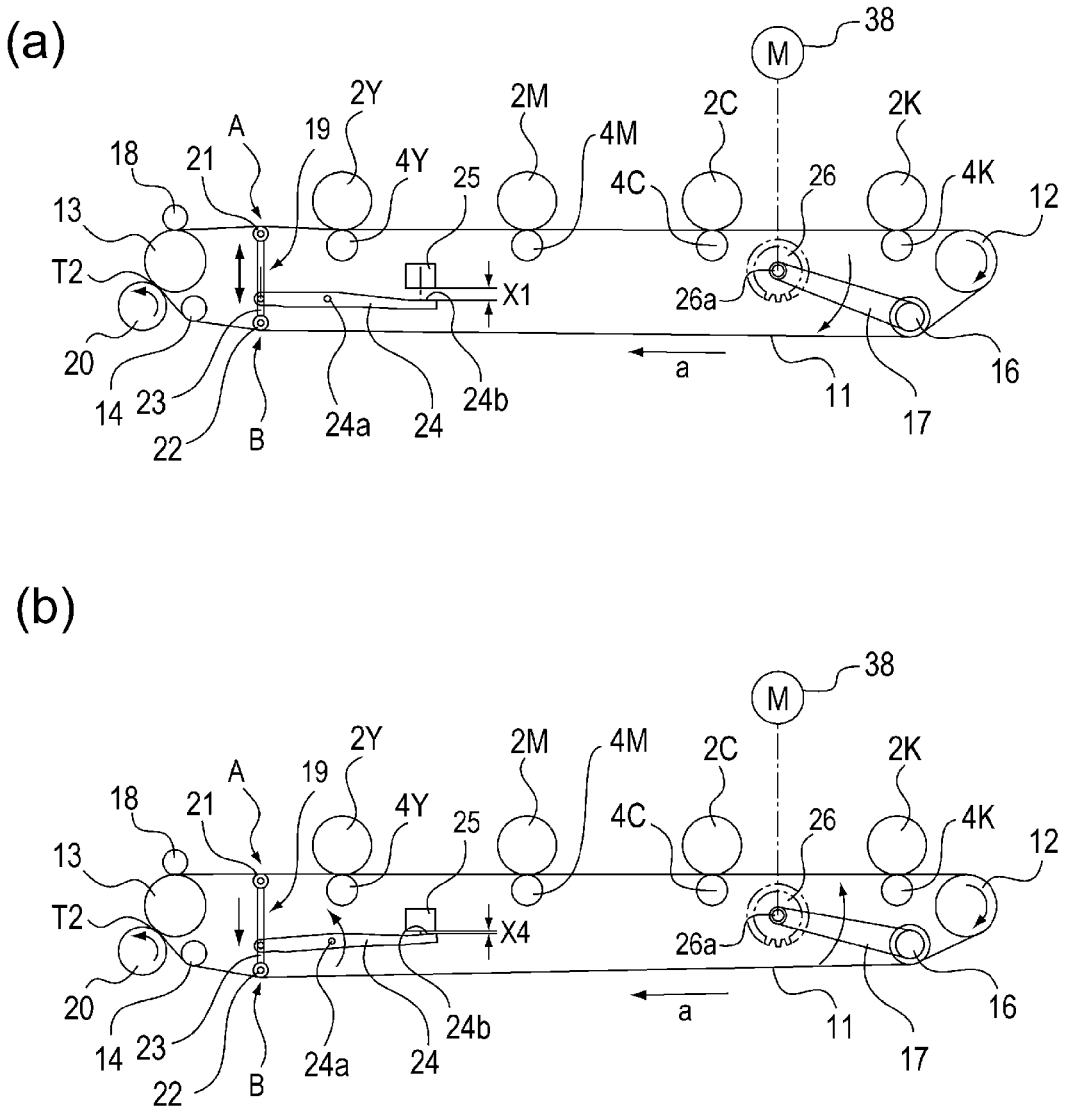

Parts (*a*) and (*b*) of FIG. 5 are schematic sectional views for illustrating an operation of a tension detecting means in an image forming apparatus according to a Second Embodiment of the present invention.

Figure 6:
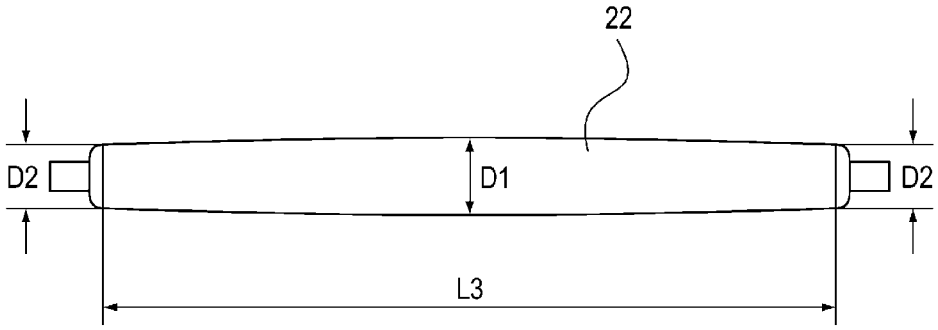

FIG. 6 is a schematic sectional illustration of a roller member provided to a movable member contacted to an image carrying belt.

Figure 7:
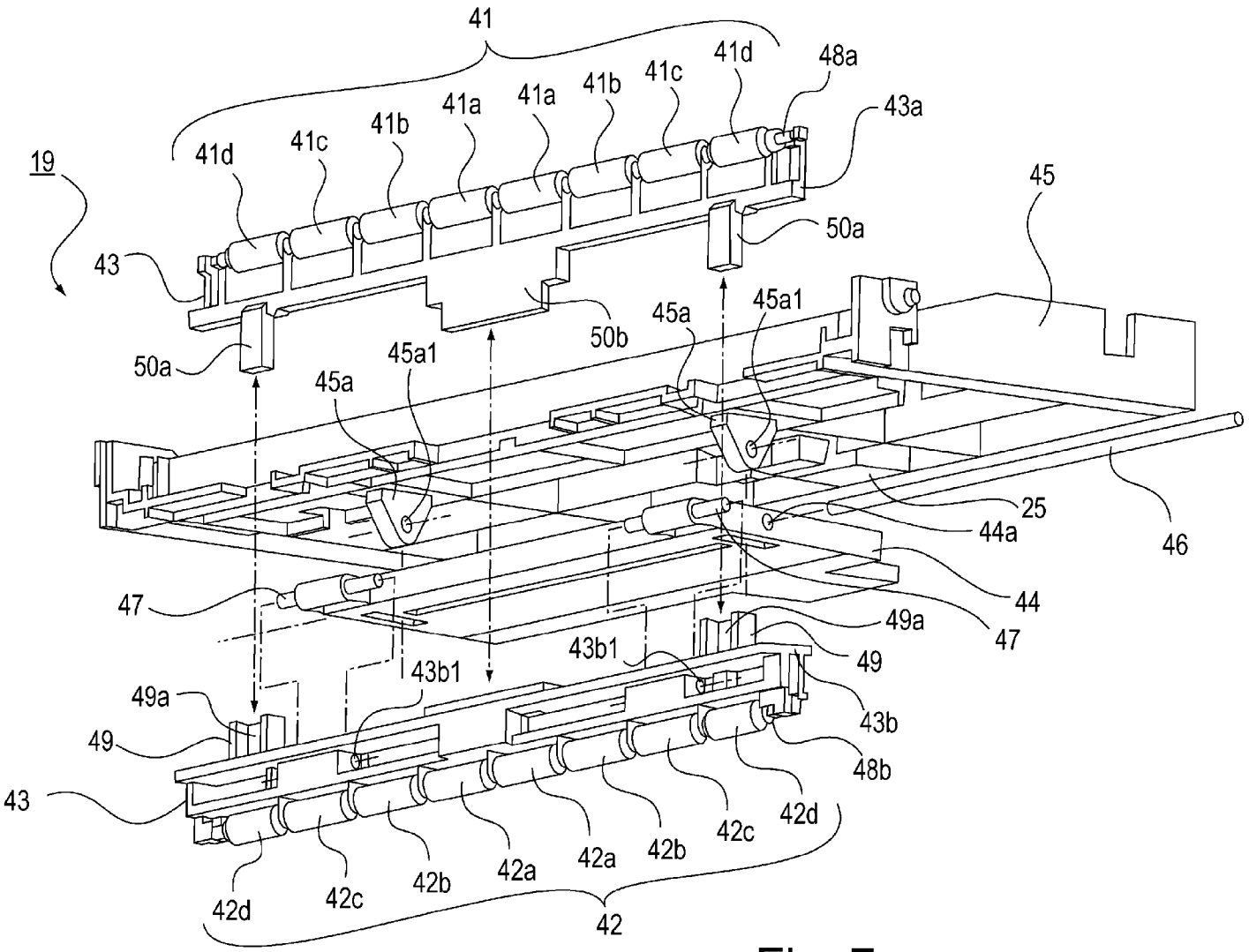

FIG. 7 is an exploded perspective view showing a structure of tension detecting means in an image forming apparatus according to a Third Embodiment of the present invention.

Figure 8:
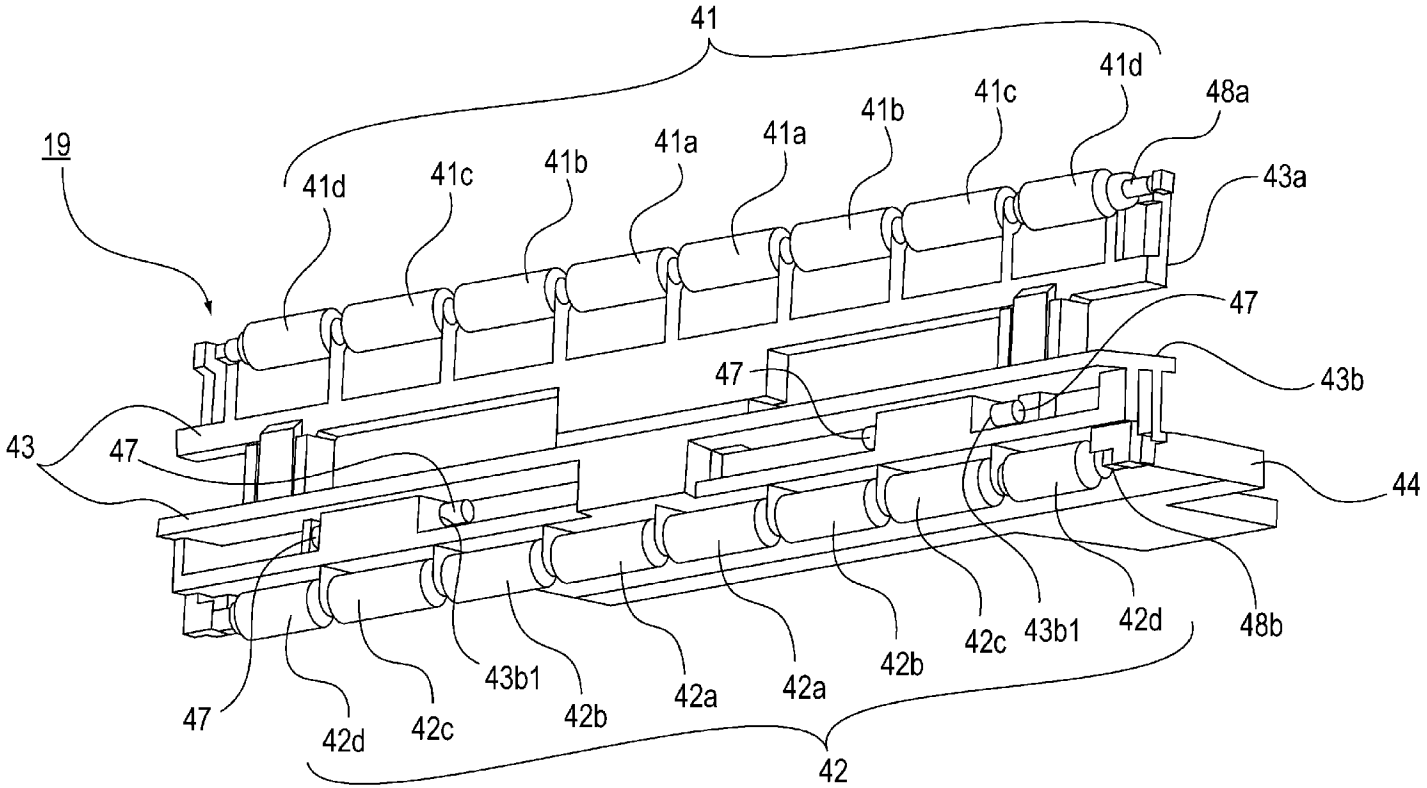

FIG. 8 is an assembling perspective view of the structure of the tension detecting means in the Third Embodiment.

Figure 9:
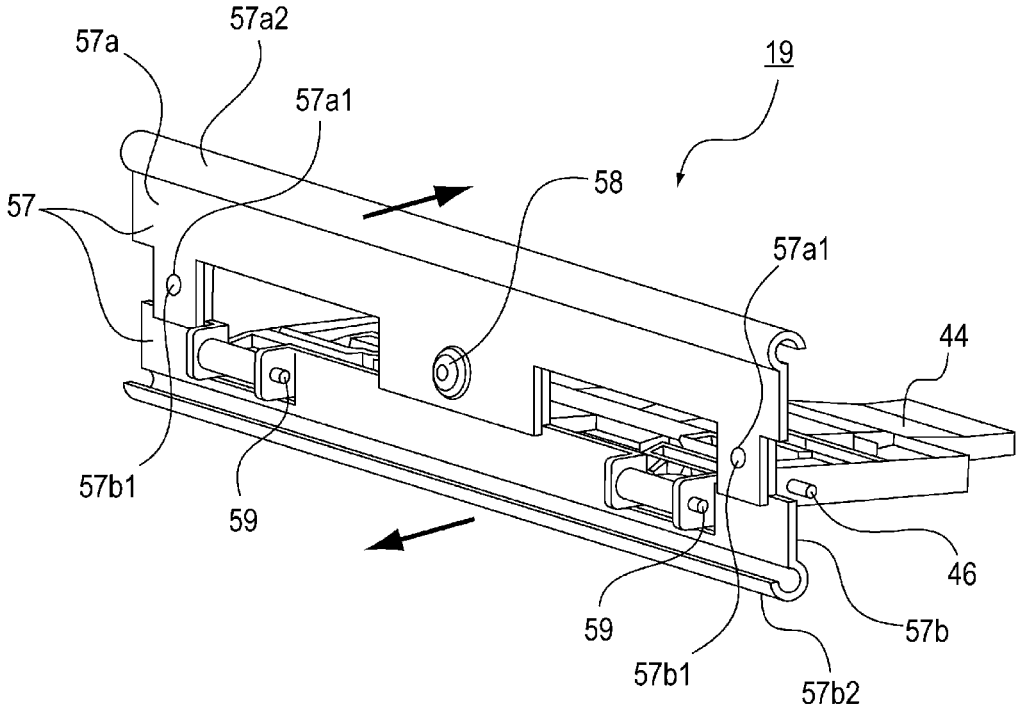

FIG. 9 is a perspective illustration showing a structure of tension detecting means in an image forming apparatus according to a Fourth Embodiment of the present invention.

Figure 10:
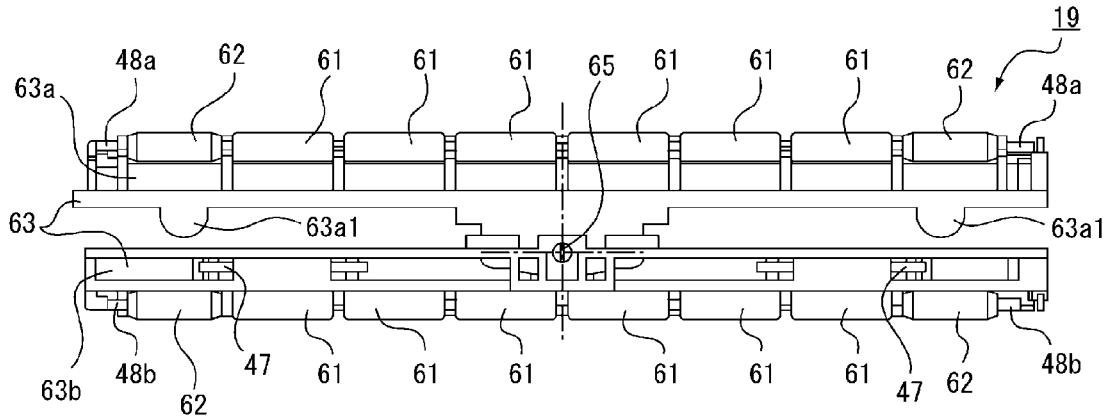
Figure 10:
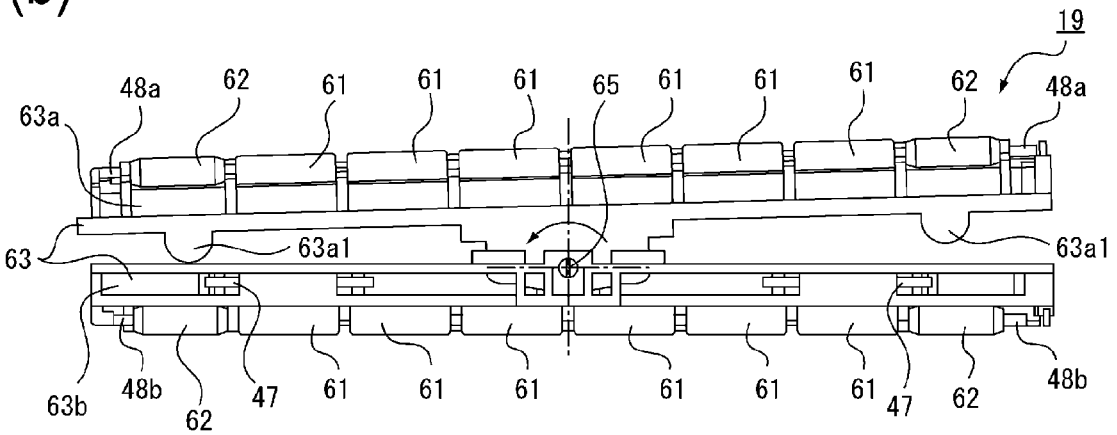
Figure 10:
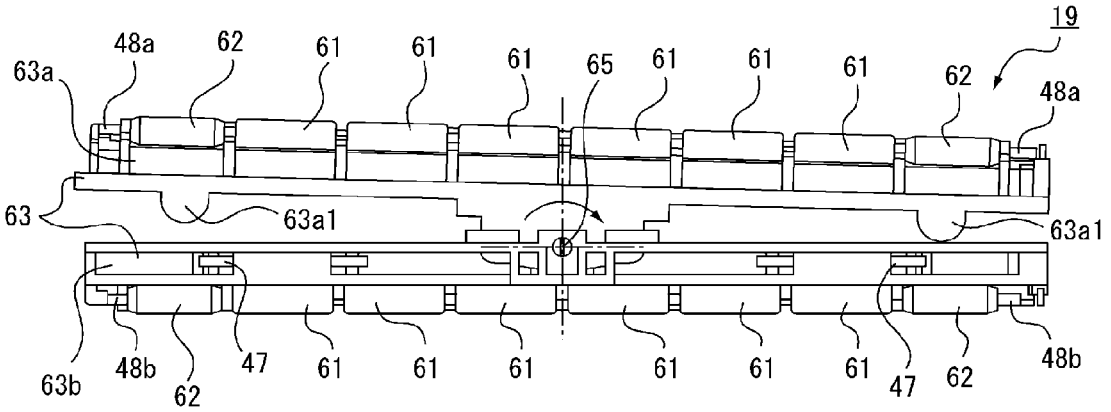

Parts (*a*) to (*c*) of FIG. 10 are schematic front views for illustrating an operation of tension detecting means in an image forming apparatus according to a Fifth Embodiment of the present invention.

Figure 11:
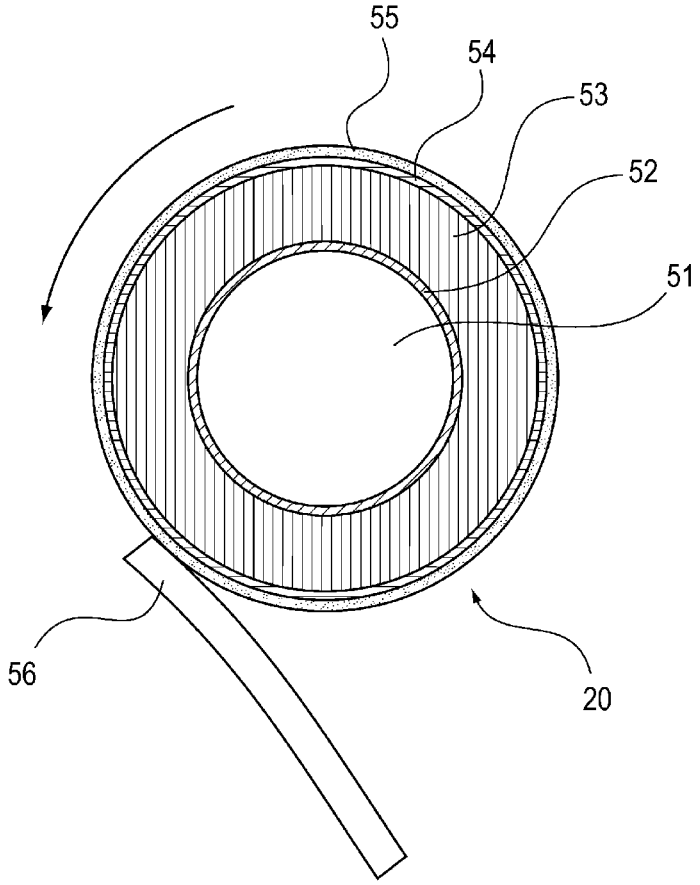

FIG. 11 is a schematic illustration showing a structure of a secondary transfer roller in an image forming apparatus according to a Sixth Embodiment of the present invention.

DESCRIPTION OF THE PREFERRED EMBODIMENTS

Hereinbelow, preferred embodiments of the present invention will be exemplarily and specifically described with reference to the drawings. However, dimensions, materials, shapes, relative arrangements and the like of constituent elements described in the following embodiments are appropriately changed depending on constitutions or various conditions of apparatuses to which the present invention is applied. Therefore, the scope of the present invention is not limited thereto unless otherwise specified.

First Embodiment

Figure 1:
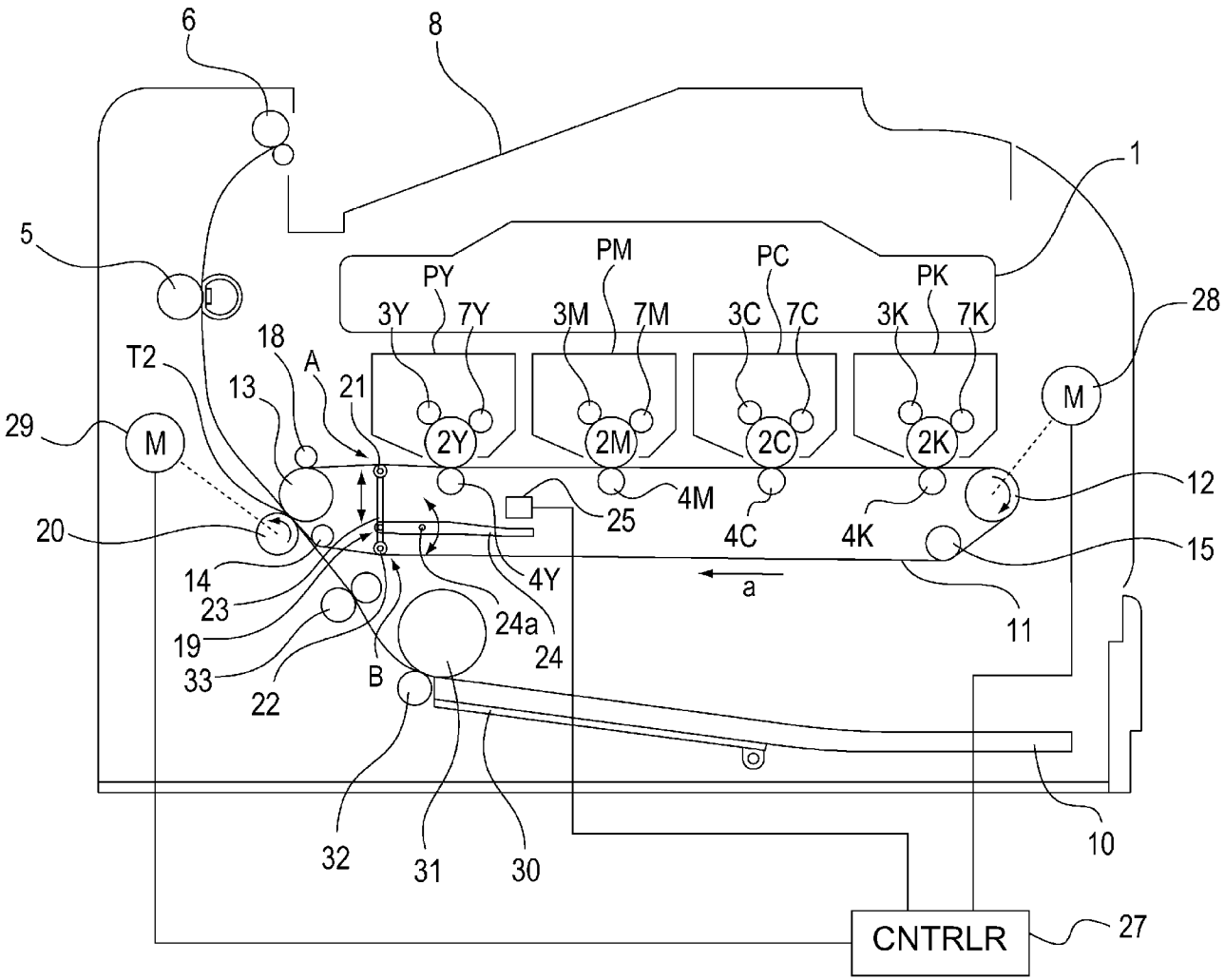
FIG. 1 is a schematic sectional view showing a structure of an image forming apparatus according to a First Embodiment of the present invention.

In this embodiment, as shown in FIG. 1, an image forming apparatus includes four photosensitive drums 2Y, 2M, 2C and 2K for Y (yellow), M (magenta), C (cyan) and K (black), respectively, as an image bearing member on which an electrostatic latent image. In the image forming apparatus, these four photosensitive drums 2Y, 2M, 2C and 2K are juxtaposed.

At peripheries of the photosensitive drums 2Y, 2M, 2C and 2K, from an upstream side with respect to their rotational directions, primary charging devices 7Y, 7M, 7C and 7K and developing devices 3Y, 3M, 3C and 3K are provided.

In this embodiment, image forming portions PY, PM, PC and PK as an image forming means for forming a toner image by developing the electrostatic latent image formed on each of the photosensitive drums 2Y to 2K (image bearing member) have the substantially same constitution except for development colors. In the following, in order to avoid a complicated description, the four image forming portions PY for Y, PM for M, PC for C and PK for K will be described representatively as an image forming portion P. This is also true for respective process means of the image forming portion P.

At an opposing position to the photosensitive drum 2, as a primary transfer means for transferring the toner image from the photosensitive drum 2 onto an intermediary transfer belt 11, a primary transfer roller 4 (4Y, 4M, 4C or 4K) is provided. The intermediary transfer belt 11 onto which the toner image formed on the surface of the photosensitive drum 2 is transferred is sandwiched between the photosensitive drum 2 and the primary transfer roller 4. The intermediary transfer belt 11 is an endless belt.

The intermediary transfer belt 11 is stretched and rotationally driven by a driving roller 12, a secondary transfer opposite roller 13 and follower rollers 14 and 15. The driving roller 12 is a first driving member for stretching and driving the intermediary transfer belt 11 and is rotationally driven by a driving motor 28 as a first driving source.

Opposite to the secondary transfer opposite roller 13, a secondary transfer roller 20 as a secondary transfer device for transferring the toner image from the intermediary transfer belt 11 onto a recording material 10 is provided. The secondary transfer roller 20 also has the function as a second driving member for applying a driving force to the intermediary transfer belt 11 in contact to an outer peripheral surface of the intermediary transfer belt 11. The driving force applied from the secondary transfer roller 20 to the intermediary transfer belt 11 is lower than a driving force applied from the driving roller 12 to the intermediary transfer belt 11.

At an inner peripheral surface of the intermediary transfer belt 11, a tension detecting unit 19 for detecting tension state of the intermediary transfer belt 11 is provided.

The tension detecting unit 19 includes contact members 21 and 22 simultaneously contacted to the inner peripheral surface of the intermediary transfer belt 11 at two positions A and B upstream and downstream, respectively, of the secondary transfer roller 20 with respect to a rotational direction of the intermediary transfer belt 11. Each of the contact members 21 and 22 is a rotatable roller which is rotatably shaft-supported. The tension detecting unit 19 also includes a connecting member 23 for connecting these rollers 21 and 22. The contact members 21 and 22 and the connecting member 23 constitute a movable device. The movable device is a movable member which is changed in its position depending on a change in tension of the intermediary transfer belt at the two positions A and B. Further, the tension detecting unit 19 includes a tension detection lever 24 as a member to be detected which is changed in its position in interrelation with the positional change of the connecting member 23. In addition, the tension detecting unit 19 includes a distance measuring sensor 25 as a detecting device for detecting the position of the tension detection lever 24.

On the basis of a detection result of the distance measuring sensor 25 provided to the tension detecting unit 19, a driving motor 29 as a second driving source is driven and controlled by a controller 27 to change a rotational speed of the secondary transfer roller 20.

A cross-sectional shape of each of the rollers 21 and 22 may preferably be, as will be described later with reference to FIG. 6, a (widthwise) central portion with respect to a widthwise direction (perpendicular to the drawing sheet surface of FIG. 1) of the intermediary transfer belt 11.

Even in the case where the intermediary transfer belt 11 is deviated relative to the rollers 21 and 22 in a main scan direction (the widthwise direction of the intermediary transfer belt 11), by a tapered shape of each of the rollers 21 and 22, a load is not exerted on the intermediary transfer belt 11.

The intermediary transfer belt 11 is stretched in a predetermined tension-applied state by the driving roller 12, the secondary transfer opposite roller 13, the follower rollers 14 and 15, and the rollers 21 and 22 of the tension detecting unit 19. The driving roller 12 is rotationally driven by driving and controlling the driving motor 28 by the controller 27.

The tension for stretching the intermediary transfer belt 11 is set at a value not less than a necessary minimum value for conveying the intermediary transfer belt 11 by the driving roller 12. This tension value varies depending on a material of the driving roller 12, a friction coefficient of the surface of the driving roller 12, a friction coefficient of the inner peripheral surface (back surface) of the intermediary transfer belt 11, a width of the intermediary transfer belt 11, a winding angle of the intermediary transfer belt 11 about the driving roller 12, and the like.

In this embodiment, the tension of 20 N is applied to the intermediary transfer belt 11 of 240 mm in width. As the intermediary transfer belt 11, a 100 μm-thick endless resin belt adjusted to have a volume resistivity of about $10^{10}$ Ω·cm by adding an ion conductive agent was used.

As a material of the intermediary transfer belt 11, in this embodiment, polyvilidene fluoride (PVDF) was used. In place of PVDF, it is also possible to use polyimide, polycarbonate, polyethylene, polypropylene, polyamide, polysulfone, polyarylate, polyethylene terephthlate and polyether sulfone. Further, another resin material such as thermoplastic polyimide may also be used. In addition, the intermediary transfer belt 11 may be prepared by forming a curable layer of the resin such as acrylic resin on the surface layer of the above resin materials.

As the driving roller 12, a roller prepared by coating a hollow aluminum pipe of 24 mm in outer diameter with a 0.5 mm-thick layer of EPDM (ethylene-propylene-dien) rubber to have an electric resistance of $10^5$ Ω or less was used.

Further, a cleaning roller 18 for removing a toner (residual toner) deposited on the intermediary transfer belt 11 is provided in contact to the intermediary transfer belt 11 and is rotated by rotational movement of the intermediary transfer belt 11.

The secondary transfer roller 20 is provided at a position where it opposes the secondary transfer opposite roller 13 via the intermediary transfer belt 11 and is contacted to the outer peripheral surface of the intermediary transfer belt 11 by being urged in one direction by an unshown spring, thus forming a secondary transfer nip T2. The secondary transfer roller 20 is rotationally driven by the driving motor 29.

In this embodiment, as the secondary transfer roller 20, a roller prepared by coating a 6 mm-thick layer of an electroconductive foam rubber on a core metal 51 of stainless steel (SUS) to have a hardness of 30 degrees (Asker-C hardness under a load of 4.9 N (500 gf)), an outer diameter of 18 mm and an electric resistance of 1×10 Ω was used.

<Operation of Image Forming Apparatus>

An image forming operation of the above-constituted image forming apparatus will be described.

When the image forming operation is started, sheets of the recording material 10 in a sheet cassette 30 are separated and fed one by one by co-operation of a feeding roller 31 and a separation roller 32 and the separated recording material 10 is conveyed to a registration roller pair 33.

At this time, rotation of the registration roller pair 33 is stopped. The recording material 10 is abutted in a nip of the registration roller pair 33, so that oblique movement of the recording material 10 is remedied.

On the other hand, in parallel to the conveying operation of the recording material 10, e.g., the surface of the photosensitive drum 2Y for yellow (Y) is negatively charged uniformly by the primary charging device 7Y and is then subjected to image exposure by an exposure device 1.

As a result, the electrostatic latent image corresponding to a yellow image component of an image signal is formed on the surface of the photosensitive drum 2Y. Then, the developing device 3Y is contacted to the photosensitive drum 2Y and then the electrostatic latent image is developed by the developing device 3Y with a negatively charged yellow toner, thus being visualized as a yellow toner image.

The thus-obtained yellow toner image is primary-transferred from the photosensitive drum 2Y onto the intermediary transfer belt 11 by the primary transfer roller 4Y supplied with a primary transfer bias.

Such a series of operations of the toner image formation is successively performed with predetermined timing also with respect to other photosensitive drums 2M, 2C and 2K.

The color toner images formed on the photosensitive drums 2 are successively primary-transferred superposedly onto the intermediary transfer belt 11 at the respective primary transfer portions.

The four color toner images transferred superposedly on the intermediary transfer belt 11 are moved to the secondary transfer nip T2 with the rotation of the intermediary transfer belt 11 in an arrow a direction shown in FIG. 1.

Further, the recording material 10 subjected to the remedy of the oblique movement by the registration roller pair 33 is sent to the secondary transfer nip T2 by being timed to the toner images on the intermediary transfer belt 11. Thereafter, by the secondary transfer roller 20, the four color toner images are collectively secondary-transferred from the intermediary transfer belt 11 onto the recording material 10.

The recording material 10 on which the toner images are transferred in this way is conveyed to a fixing device 5, in which the toner images are fixed thereon under application of heat and pressure, and thereafter is discharged and stacked on a discharge tray 8 by a discharging roller pair 6.

Incidentally, a transfer residual toner remaining on the intermediary transfer belt 11 after the end of the secondary transfer is removed by the cleaning roller 18 contacted to the intermediary transfer belt 11 stretched by the secondary transfer opposite roller 13.

<Tension Detecting Unit>

A constitution of the tension detecting unit 19 will be described with reference to (*a*) to (*c*) of FIG. 2.

The tension detecting unit 19 is used to detect a balance of the tension state of the intermediary transfer belt 11 at the two positions A and B on the intermediary transfer belt 11 shown in FIG. 2.

When the rotational speed of the intermediary transfer belt 11 by the driving roller 12 and the rotational speed of the intermediary transfer belt 11 by the secondary transfer roller 20 are completely equal to each other, the tension state at each of the positions A and B on the intermediary transfer belt 11 is referred to as an ideal tension state. A position of the connecting member 23 in the ideal tension state is referred to as a neutral position.

In the ideal tension state, the tension detection lever 24 is configured so that a force applied to the intermediary transfer belt 11 from the rollers 21 and 22 provided at both ends of the connecting member 23 is smaller than a weight of the connecting member 23.

As described above, the tension detecting unit 19 includes the two rollers 21 and 22 at the upper and lower end portions of the connecting member 23 and includes the connecting member 23 configured to be vertically movable. Further, the tension detecting unit 19 includes the tension detection lever 24 which is provided rotatably about supporting shaft 24*a* as a rotation center provided on an apparatus frame and which is changed in position depending on vertical motion of the connecting member 23. Further, the distance measuring sensor 25 is provided opposed to a reflection surface 24*b* (opposing surface) of the tension detection lever 24 provided at a position opposite from the connecting member 23 with respect to the supporting shaft 24*a* of the tension detection lever 24. The distance measuring sensor 25 detects a spacing distance between itself and the reflection surface 24*b* of the tension detection lever 24 rotationally moved about the supporting shaft 24*a*.

The roller 21 rotatably shaft-supported at the upper end of the connecting member 23 is disposed downstream (position A in FIG. 2) of the secondary transfer nip T2 with respect to the rotational direction of the intermediary transfer belt 11. Similarly, the roller 22 rotatably shaft-supported at the lower end of the connecting member 23 is disposed upstream (position B in FIG. 2) of the secondary transfer nip T2 with respect to the rotational direction of the intermediary transfer belt 11.

The rollers 21 and 22 are disposed so as to be contacted to the inner peripheral surface of the intermediary transfer belt 11.

An arrangement, weight and center of gravity of each of parts of the tension detecting unit 19 are constituted so that the position of the connecting member 23 is constituted so as to be balanced with the substantially same position as the neutral position even in a state in which the intermediary transfer belt 11 is not stretched. That is, even in a state in which there is no intermediary transfer belt 11, the position of the connecting member 23 in the tension detecting unit 19 is constituted so as to be balanced with the substantially same position as the neutral position. As a result, a force for moving the connecting member 23 from the neutral position by a certain amount (distance) cancels the weight of the connecting member 23, so that the connecting member 23 is not substantially moved in the vertical direction.

Therefore, the tension detecting unit 19 is operable with high accuracy with respect to the tension fluctuation generated on the intermediary transfer belt 11 at each of the positions A and B in each of the tension-applied state and the tension-relieved state.

Further, an external force such as a spring force is not applied to the tension detecting unit 19 and therefore the connecting member 23 is sensitive to the external force. Accordingly, the connecting member 23 sensitively follows even a slight tension fluctuation at the positions A and B on the intermediary transfer belt 11 shown in FIG. 2, thus being capable of detecting a slight change in tension balance.

The distance measuring sensor 25 detects the position of the reflection surface 24*b* of the tension detection lever 24 and is of an infrared type. In this embodiment, the distance measuring sensor 25 includes, as shown in FIG. 3, a light emitting portion 34 constituted by an LED (light emitting diode) and a light receiving portion 36 constituted by a PSD (position sensitive device; position detecting element).

An infrared ray 37 is emitted from the light emitting portion 34 onto the reflection surface 24*b* of the tension detection lever 24, and reflection light diffused and reflected by the reflection surface 24*b* is focused by a light-receiving condenser lens 35 provided in front of a light receiving surface 36*a* of the light receiving portion 36, thus being guided to the light receiving surface 36*a*. Based on the position of a center of distribution of the infrared ray 37 which reaches the light receiving surface 36*a*, the spacing distance to the reflection surface 24*b* of the tension detection lever 24 is measured by the triangulation method.

The distribution center position of the infrared ray 37 which reaches the light receiving surface 36*a* is detected and converted into the distance and therefore even when a reflectance is changed depending on a surface state of the reflection surface 24*b* of the tension detection lever 24, the change does not influence the distance data. The position detected by the light receiving portion is converted into the distance by a processing IC (integrated circuit) 9 and then is outputted as a voltage value.

In this embodiment, the tension detection lever 24 as an object to be detected by the distance measuring sensor 25 is formed of a white resin material and the surface of the reflection surface 24*b* is gloss-finished, so that a light reflectance at the reflection surface 24*b* was set at 90%. In another example, the tension detection lever 24 itself is formed of metal or, the tension detection lever 24 and the reflection surface 24*b* may also be formed as separate members by, e.g., bonding a high-reflectance sheet to the reflection surface 24*b*. Further, the reflectance of the reflection surface 24*b* is not limited to 90% but may also be set at an arbitrary value.

A relationship between the distance from the distance measuring sensor 25 to the member to be detected and the output voltage in this embodiment is shown in FIG. 4.

A detection range may preferably be such that sensitivity of the output voltage to the distance to the member to be detected is not abruptly changed throughout the entire range and is also high. Therefore, in this embodiment, the distance measuring sensor 25 was disposed so that the spacing distance from the distance measuring sensor 25 to the reflection surface 24*b* of the tension detection lever 24 is a range R, shown in FIG. 4, ranging from 4 mm to 10 mm.

Specifically, as shown in FIG. 2, a lever ratio L1:L2 between a length L1 from the supporting shaft 24*a* to a connecting portion where the tension detection lever 24 is connected to the connecting member 23 and a length L2 from the supporting shaft 24*a* to a measuring position of the distance measuring sensor 25 opposing the reflection surface 24*b* is set at 2:5. Thus, a vertical movement amount of the reflection surface 24*b* of the tension detection lever 24 at the measuring position of the distance measuring sensor 25 was set so as to be amplified to about 2.5 times that of the connecting member 23.

That is, a vertical movable range of the tension detection lever 24 at the detection position by the distance measuring sensor 25 is constituted so as to be larger than that of the connecting member 23.

As a result, a slight tension fluctuation of the intermediary transfer belt 11 at the positions A and B shown in FIG. 2 is detectable with high accuracy.

Further, in the neutral state of the tension detecting unit 19 shown in (*a*) of FIG. 2, a projection amount A1 from a common tangential line of the outer peripheral surface the transfer opposite roller 13 and the primary transfer roller 4Y at the position A on the intermediary transfer belt 11 was set at 1.2 mm. Further, a projection amount B1 from a common tangential line of the outer peripheral surface of the follower roller 14 and the outer peripheral surface of the follower roller 15 was set at 2.8 mm.

Therefore, as shown in (*b*) of FIG. 2, on the intermediary transfer belt 11, in a tension-applied side at the position A, a maximum movable amount from the neutral state of the connecting member 23 is 1.2 mm and this corresponds to a movement amount of 3 mm (1.2 mm×2.5=3 mm) at the measuring position of the distance measuring sensor 25.

On the other hand, in a tension-relieved side at the position A on the intermediary transfer belt 11, a detection width of the distance measuring sensor 25 is 3 mm. Further, the distance measuring sensor 25 is disposed so that the spacing distance between the distance measuring sensor 25 and the reflection surface 24*a* of the tension detection lever 24 is 7 mm in the neutral state shown in (*a*) of FIG. 2. As a result, a detection distance on the distance measuring sensor 25 with respect to an operation range of the tension detecting unit 19 is from 4 mm (7 mm−3 mm=4 mm) to 10 mm (3 mm+7 mm=10 mm) as indicated by a range R shown in FIG. 4.

As a result, the tension detecting unit 19 is capable of detecting the tension fluctuation occurring in the intermediary transfer belt 11 with high accuracy in each of the tension-applied side and the tension-relieved side at the position A or the position B shown in FIG. 2.

<Operation of Tension Detecting Unit>

With reference to FIG. 2, the operation in this embodiment regarding the tension fluctuation of the intermediary transfer belt 11 will be described.

Part (*a*) of FIG. 2 shows a state in which the connecting member 23 is located at the neutral position, i.e., a state in which the rotational speed of the intermediary transfer belt 11 driven by the secondary transfer roller 20 and the rotational speed of the intermediary transfer belt 11 driven by the driving roller 12 are completely equal to each other. Further, (*a*) of FIG. 2 shows that the tension of the intermediary transfer belt 11 at the positions A and B is in an ideal state.

In this case, a spacing distance X1 from the distance measuring sensor 25 to the reflection surface 24*b* of the tension detection lever 24 is, as described above, weights and supporting point balance of the parts of the tension detecting unit 19 are constituted so as to be the substantially same even in the state in which there is no intermediary transfer belt 11. In this embodiment, X1 is set at 7 mm.

Part (*b*) of FIG. 2 shows a state in which the tension of the intermediary transfer belt 11 at the position A is high.

The rotational speed of the secondary transfer roller 20 becomes slow, so that a tangential force in a direction indicated by an arrow b in (*b*) of FIG. 2 is generated at the secondary transfer nip T2. Thus, the tension of the intermediary transfer belt 11 at the position A between the downstream side of the secondary transfer nip T2 and the primary transfer nip where the photosensitive drum 2Y and the primary transfer roller 4Y via the intermediary transfer belt 11 becomes high. On the other hand, the tension at the position belt between the downstream side of the driving roller 12 and the secondary transfer nip T2 becomes low.

By a change in tension balance of the intermediary transfer belt 11, the connecting member 23 is pushed down at the position A by the intermediary transfer belt 11. At the same time, the connecting member 23 pushes down the intermediary transfer belt 11 at the position B. That is, the connecting member 23 moves downward as shown in (*b*) of FIG. 2.

In synchronism with this motion of the connecting member 23, the tension detection lever 24 is rotationally moved about the supporting shaft 24*a* in the counterclockwise direction shown in (*b*) of FIG. 2. Then, the spacing distance between the distance measuring sensor 25 and the reflection surface 24*a* of the tension detection lever 24 is changed from the spacing distance X1 at the neutral position shown in (*a*) of FIG. 2 to a spacing distance X2 (=X1−α) as shown in (*b*) of FIG. 2. Feed-back control of the driving motor 29 is effected so that the tension state is changed to the target tension state at the neutral position shown in (*a*) of FIG. 2, depending on a voltage value outputted from the distance measuring sensor 25 with the spacing distance X2, by the controller 27 provided in the image forming apparatus, so that the rotational speed of the secondary transfer roller 20 is changed. Specifically, in order to increase the spacing distance between the distance measuring sensor 25 and the reflection surface 24*a* of the tension detection lever 24, the rotational speed of the secondary transfer roller 20 is increased. By increasing the rotational speed of the secondary transfer roller 20, the connecting member 23 is pushed up at the position B by the intermediary transfer belt 11. Simultaneously with this, the connecting member 23 pushes up the intermediary transfer belt 11 at the position A. That is, the connecting member 23 moves to the position shown in (*a*) of FIG. 2.

Contrary to (*b*) of FIG. 2, (*c*) of FIG. 2 shows a state in which the tension of the intermediary transfer belt 11 at the position A is low.

The rotational speed of the secondary transfer roller 20 becomes fast, so that a tangential force in a direction indicated by an arrow c in (*c*) of FIG. 2 is generated at the secondary transfer nip T2. Thus, the tension of the intermediary transfer belt 11 at the position A between the downstream side of the secondary transfer nip T2 and the primary transfer nip where the photosensitive drum 2Y and the primary transfer roller 4Y meet via the intermediary transfer belt 11 becomes low. On the other hand, the tension at the position belt between the downstream side of the driving roller 12 and the secondary transfer nip T2 becomes high.

By a change in tension balance of the intermediary transfer belt 11, the connecting member 23 is pushed up at the position B by the intermediary transfer belt 11. At the same time, the connecting member 23 pushes up the intermediary transfer belt 11 at the position A. That is, the connecting member 23 moves upward as shown in (*c*) of FIG. 2.

In synchronism with this motion of the connecting member 23, the tension detection lever 24 is rotationally moved about the supporting shaft 24*a* in the clockwise direction shown in (*c*) of FIG. 2. Then, the spacing distance between the distance measuring sensor 25 and the reflection surface 24*a* of the tension detection lever 24 is changed from the spacing distance X1 at the neutral position shown in (*a*) of FIG. 2 to a spacing distance X3 (=X1+β) as shown in (*c*) of FIG. 2. Feed-back control of the driving motor 29 is effected so that the tension state is changed to the target tension state at the neutral position shown in (*a*) of FIG. 2, depending on a voltage value outputted from the distance measuring sensor 25 with the spacing distance X2, by the controller 27 provided in the image forming apparatus, so that the rotational speed of the secondary transfer roller 20 is changed. Specifically, in order to decrease the spacing distance between the distance measuring sensor 25 and the reflection surface 24*a* of the tension detection lever 24, the rotational speed of the secondary transfer roller 20 is decreased.

As described above, in some cases, a difference is generated between the rotational speed of the intermediary transfer belt 11 driven by the secondary transfer roller 20 and the rotational speed of the intermediary transfer belt 11 driven by the driving roller 21. In these cases, the tension change of the intermediary transfer belt 11 at the position A and the tension change of the intermediary transfer belt 11 at the position B are in inverse proportion.

That is, on the intermediary transfer belt 11, when the tension at the position A is increased, the tension at the position B is decreased. On the other hand, when the tension at the position A is decreased, the tension at the position B is increased.

The tension detecting unit 19 is capable of detecting a tension balance state at each of the positions A and B on the intermediary transfer belt 11 with respect to both directions in which the tension at the position A or B is increased and decreased.

On the basis of the detection result of the tension detecting unit 19, by adjusting the rotational speed of the secondary transfer roller 20 by the controller 27 so that the tension balance is always the ideal tension balance, it is possible to minimize a degree of the image defect such as the color misregistration or the transfer deviation.

In the image forming apparatus having the above-described constitution in this embodiment and in the conventional image forming apparatus, printing of 2 pages in total was performed 10 times by the one-sheet intermittent operation (a print job in which a rest time is provided after the printing of 1 page (sheet)). With respect to an occurrence probability of the transfer deviation and a degree of the color misregistration in a sub-scan direction (the rotational speed of the intermediary transfer belt) in the printing of 20 sheets in total were compared between the image forming apparatus in this embodiment and the conventional image forming apparatus. Incidentally, in the conventional image forming apparatus, a constitution in which a tension detection result of the intermediary transfer belt 11 is not fed back to the rotational drive control of the driving motor 29 for driving the secondary transfer roller 20 is employed.

In general, an amount of the color misregistration of 150 μm or more is easily recognizable and therefore the color misregistration amount may desirably be 100 μm or less. In a preferred example, the color misregistration amount is 50 μm or less, so that blur of a character due to the color misregistration and a change of mixed color of two or more colors are not conspicuous.

As a result of the comparison between the image forming apparatus in this embodiment and the conventional image forming apparatus, in the case of using the conventional image forming apparatus, the occurrence probability of the transfer deviation was about 10% and the color misregistration was 120 μm as a worst value and 80 μm as an average value. On the other hand, in the case of using the image forming apparatus in this embodiment, the transfer deviation did not occur and the color misregistration was 80 μm as the worst value and 50 μm as the average value, thus being remarkably improved.

In this embodiment, in either case of when the rotational speed of the secondary transfer roller 20 is higher and lower than the rotational speed of the driving roller, a slight tension fluctuation of the intermediary transfer belt 11 is detected with high sensitivity and high accuracy. Further, it is possible to eliminate the tension non-uniformity of the intermediary transfer belt 11 by changing and correcting the rotational speed of the secondary transfer roller 20, so that the image forming apparatus with less color misregistration and less transfer deviation can be provided.

Second Embodiment

With reference to (*a*) and (*b*) of FIG. 5 and FIG. 6, an image forming apparatus according to the Second Embodiment of the present invention will be described. Incidentally, constituent portions which are the same as those in the First Embodiment are represented by the same reference numerals or symbols and will be omitted from description.

In this embodiment, in place of the follower roller 15 for stretching the intermediary transfer belt 11 in the First Embodiment, a tension roller 16 as a tension member movable toward and away from the inner peripheral surface of the intermediary transfer belt 11 is provided. The tension roller 16 is capable of performing release of the tension of the intermediary transfer belt 11 during rest of the image forming operation (in a state in which the printing operation is not performed).

As shown in FIG. 5, in this embodiment, the tension roller 16 as one of the stretching rollers for stretching the intermediary transfer belt 11 is rotatably shaft-supported by an arm member 17 at one end portion. At the other end portion of the arm member 17, the arm member 17 is fixed to a rotation shaft 26*a* of a tension adjusting gear 26 rotatably shaft-supported by an unshown apparatus frame.

Further, the arm member 27 is rotationally moved about the rotation shaft 26*a* in interrelation with the rotation of the tension adjusting gear 26 rotationally driven by a motor 38 controlled by the controller 27. Then, the tension roller 16 is contacted to and separated from the inner peripheral surface of the intermediary transfer belt 11, so that the tension application to and tension release from the intermediary transfer belt 11 can be effected.

The tension detecting unit 19 includes, similarly as in the First Embodiment, the rollers 21 and 22 vertically contacted to the inner peripheral surface of the intermediary transfer belt 11 at the positions A and B, respectively, shown in FIG. 5. The tension detecting unit 19 also includes the connecting member 23 movable in the vertical (up-down) direction indicated by an arrow in FIG. 5. Further, the tension detecting unit 19 includes the tension detection lever 24 changed in position by being rotationally moved about the supporting shaft 24*a* in interrelation with the positional change of the connecting member 23 and includes the distance measuring sensor 25 for detecting the position of the reflection surface 24*b* of the tension detection lever 24.

Here, a length L3 of the roller 22 with respect to an axial direction is, as shown in FIG. 6, shorter than a width of the intermediary transfer belt. The roller 22 contacts the inner peripheral surface of the intermediary transfer belt 11 in a range of the length L3. Further, a diameter D1 of the roller 22 at an axial direction central portion is larger than a diameter D2 of the roller 22 at an axial direction end portion (D2<D1).

As shown in (*a*) of FIG. 5, during the image forming operation, a predetermined tension is applied to the intermediary transfer belt 11 by the tension roller 16 similarly as in the follower 15 in the First Embodiment. Therefore, a series of operations relating to the rotational speed correction of the secondary transfer roller 20 with respect to the tension fluctuation is the same as that in the First Embodiment.

On the other hand, in this embodiment, the tension roller 16 is retracted from the inner peripheral surface of the intermediary transfer belt 11 during the rest of the image formation, thus releasing the tension application to the intermediary transfer belt 11.

<Operation of Tension Release and Application>

An operation for releasing tension application to the intermediary transfer belt 11 and applying the tension to the intermediary transfer belt 11 will be described.

After the image forming operation is completed, when the state of the image forming apparatus is changed to the image formation rest state, the tension adjusting gear 26 is rotationally driven about the rotation shaft 26*a* in the counterclockwise direction in FIG. 5 by the motor 38 as the driving source controlled by the controller 27. As a result, the arm member 17 is rotationally moved about the rotation shaft 26 in the counterclockwise direction in FIG. 5 in interrelation with the tension adjusting gear 26. With this rotational movement, the tension of the intermediary transfer belt 11 at the position B is decreased, so that the tension balance between the positions A and B is fluctuated.

By this change in tension balance of the intermediary transfer belt 11, the connecting member 23 of the tension detecting unit 19 is pushed down at the position A by the intermediary transfer belt 11. At the same time, the connecting member 23 pushes down the intermediary transfer belt 11 at the position B. That is, the connecting member 23 moves downward as shown in (*b*) of FIG. 5.

In synchronism with this downward motion of the connecting member 23, the tension detection lever 24 is rotationally moved about the supporting shaft 24*a* in the counterclockwise direction shown in (*b*) of FIG. 5. Then, the spacing distance between the distance measuring sensor 25 and the reflection surface 24*a* of the tension detection lever 24 is changed from the spacing distance X1 at the neutral position shown in (*a*) of FIG. 5 to a spacing distance X4 (=X1−γ) as shown in (*b*) of FIG. 5. The motor 38 as the driving source is controlled so that the tension adjusting gear 26 is stopped at the position shown in (*a*) of FIG. 5, depending on a voltage value outputted from the distance measuring sensor 25 with the spacing distance X4, by the controller 27 provided in the image forming apparatus. At this time, the tension (application) releasing operation of the intermediary transfer belt 11 is completed. In this embodiment, the spacing distance X4 (=X1−γ) is set, with respect to the spacing distance X2 (=X1−α) described above with reference to (*b*) of FIG. 2 at the time of application of the maximum tension detectable at the position A on the intermediary transfer belt 11, so as to satisfy X4>X2.

Further, after the tension application to the intermediary transfer belt 11 is released, when the operation goes to the image forming operation (during a tension restoring operation), first, the tension adjusting gear 26 is rotationally driven about the rotation shaft 26*a* in the clockwise direction in (*a*) of FIG. 5 by the motor 38 controlled by the controller 27.

As a result, the arm member 17 is rotationally moved about the rotation shaft 26*a* in the clockwise direction in (*a*) of FIG. 5 in interrelation with the tension adjusting gear 26. Further, the tension roller 16 is contacted to the inner peripheral surface of the intermediary transfer belt 11 to apply the predetermined tension to the intermediary transfer belt 11 as shown in (*a*) of FIG. 5.

During the above tension restoring operation, the rotation operations of the driving roller 12 and the secondary transfer roller 20 are stopped until a state in which the driving roller 12 does not slip on the intermediary transfer belt 11. The spacing distance between the distance measuring sensor 25 and the reflection surface 24*b* of the tension detection lever 24 when the driving roller 12 is in a state in which the driving roller 12 is capable of driving the intermediary transfer belt 11 without causing slippage is X5. When the distance measuring sensor 25 detects the spacing distance X5, the controller 27 rotationally drives the driving motors 28 and 29 to rotate the driving roller 12 and the secondary transfer roller 20, respectively, thus effecting the tension control operation of the intermediary transfer belt 11 similarly as that during the image forming operation.

Further, during the tension restoring operation, also in the case where the intermediary transfer belt 11 is deviated from the roller 22 in the main scan direction (the widthwise direction of the intermediary transfer belt 11), as described above with reference to FIG. 6, the roller 22 does not apply a load to the intermediary transfer belt 11 by the presence of the tapered shape thereof. With the rotation operation of the intermediary transfer belt 11, along the tapered shape of the roller 22, the intermediary transfer belt 11 can be moved and restored to a normal position thereof. That is, it becomes possible to effect automatic center alignment.

In this embodiment, only the roller 22 is formed in the tapered shape as shown in FIG. 6 but the roller 21 may also be formed in a cross-sectional shape similar to that of the roller 22 shown in FIG. 6.

Further, also in this embodiment, in either case of when the rotational speed of the secondary transfer roller 20 is higher and lower than the rotational speed of the driving roller, a slight tension fluctuation of the intermediary transfer belt 11 can be detected by the tension detecting unit 19 with high sensitivity and high accuracy. Further, on the basis of its detection result, it is possible to eliminate the tension non-uniformity state of the intermediary transfer belt 11 by changing and correcting the rotational speed of the secondary transfer roller 20 by controlling the driving motor 29 by the controller 27, so that the image forming apparatus with less color misregistration and less transfer deviation can be provided.

Further, in this embodiment, the tension applied to the intermediary transfer belt 11 is released by retracting the tension roller 16 from the inner peripheral surface of the intermediary transfer belt 11 during the rest of the image formation. As a result, it is possible to suppress plastic deformation (winding habit) by winding of the intermediary transfer belt about each of the stretching rollers, so that movement stability of the intermediary transfer belt 11 during the image forming operation can be maintained for a long term.

A malfunction of the tension detecting unit 19, due to a factor other than the tension fluctuation of the intermediary transfer belt 11, such as an unexpected operation of the tension detecting unit 19 at the winding habit portion of the intermediary transfer belt 11 is suppressed, so that it becomes possible to detect the tension fluctuation of the intermediary transfer belt 11 with high sensitivity and high accuracy without causing erroneous detection of the tension fluctuation of the intermediary transfer belt 11.

Further, in this embodiment, the tension roller 16 which is retractable and which apply the tension to the intermediary transfer belt 11 was of a center fixing type in which the tension roller 16 is fixedly provided at a predetermined position during the image forming operation. In addition, it is also possible to obtain a similar effect by employing a spring-urging type in which the tension roller 16 is urged against the inner peripheral surface of the intermediary transfer belt 11 by an elastic member such as spring or the like to apply a predetermined tension to the intermediary transfer belt 11. In these types, the image forming apparatus is constituted similarly as in the First Embodiment, so that a similar effect can be achieved.

Third Embodiment

With reference to FIG. 7 and FIG. 8, an image forming apparatus according to the Third Embodiment of the present invention will be described. Incidentally, constituent portions which are the same as those in the First and Second Embodiments are represented by the same reference numerals or symbols and will be omitted from description.

In this embodiment, in the tension detecting unit 19, rollers 41 and 42 of upper and lower connecting members 43*a* and 43*b* are simultaneously contacted to the inner peripheral surface of the intermediary transfer belt 11 at two positions A and B located upstream and downstream of the secondary transfer roller 20 with respect to the rotational direction of the intermediary transfer belt 11.

Further, the connecting members 43*a* and 43*b* obtained by vertically dividing the connecting member 43, into two portions, as a movable member vertically changing in position depending on the tension change of the intermediary transfer belt 11 at the positions A and B are engaged slidably in the vertical direction. At upper and lower end portions of the upper and lower connecting members 43*a* and 43*b*, the rollers 41 and 42 as a roller member contactable to the inner peripheral surface of the intermediary transfer belt 11 are rotatably shaft-supported.

In this embodiment, the tension detecting unit 19 includes the connecting member 43*a* including a plurality of rollers 41*a*, 41*b*, 41*c* and 41*d* as the roller member to be contacted to the inner peripheral surface of the intermediary transfer belt 11. Similarly, the tension detecting unit 19 includes the connecting member 43*b* including a plurality of rollers 42*a*, 42*b*, 42*c* and 42*d* as the roller member to be contacted to the inner peripheral surface of the intermediary transfer belt 11. Further, the tension detecting unit 19 includes a tension detection lever 44 as the member to be detected which is changed in position by being rotationally moved about a supporting shaft 46 in interrelation with the position change of the connecting member 43*b* in the vertical direction.

As shown in FIGS. 7 and 8, the supporting shaft 46 is inserted into a through hole 45*a*1 of a projection 45 provided at a lower portion of an intermediary transfer member frame 45 mounted in the main assembly of the image forming apparatus and a through hole 44*a* provided at the rotation center of the tension detection lever 44. As a result, the tension detection lever 44 is shaft-supported rotatably about the supporting shaft 46 by the intermediary transfer member frame 45.

Further, the lower connecting member 43*b* is shaft-supported rotatably about a supporting shaft 47 by the tension detection lever 44 by inserting the supporting shaft 47 provided to the tension detection lever 44 into a through hole 43*b*1 provided in the connecting member 43*b*.

In the neighborhood of each of both end portions of the lower connecting member 43*b* at an upper surface, a guide rail 49 provided with a guide groove 49*a* is provided vertically, and at a central portion of the connecting member 43*b* at the upper surface, an unshown engaging hole is provided. On the other hand, in the neighborhood of each of both end portions of the upper connecting member 43*a* at a lower surface, a projection 50*a* to be slidably inserted into the guide groove 49*a* of the guide rail 49 provided at the upper surface of the lower connecting member 43*b* is vertically provided. Further, at a central portion of the upper connecting member 43*a* at the lower surface, a projection 50*b* to be inserted slidably into the unshown engaging hole provided at the upper surface of the lower connecting member 43*b* is provided vertically.

Further, the projection 50*a* of the connecting member 43*a* is inserted into the guide groove 49*a* of the guide rail 49 of the connecting member 43*b* rotatably shaft-supported about the supporting shaft 47 by the tension detection lever 44. Then, the projection 50*b* of the connecting member 43*a* is inserted into the unshown engaging hole provided at the upper surface of the connecting member 43*b*. As a result, the connecting member 43*a* mounted in the upper side is slidably supported in the vertical direction by the connecting member 43*b* mounted in the lower side.

In this embodiment, in consideration of an assembling property, the connecting member 43*a* and the connecting member 43*b* are held only by engaging the projections 50*a* and 50*b* with the guide groove 49*a* and the unshown engaging hole, respectively, and these members are not fixed with respect to their separation direction (disconnecting direction).

Further, similarly as in the above-described embodiments, when the rotational speed of the intermediary transfer belt 11 by the driving roller 12 and the rotational speed of the intermediary transfer belt 11 by the secondary transfer roller 20 are equal to each other, the tension detection lever 24 is configured so that a force applied to the intermediary transfer belt 11 by the connecting member 43 is smaller than a weight of the connecting member 43. That is, the tension detecting unit 19 is set so as to balance about the supporting shaft 46 at the substantially same position as the position of the intermediary transfer belt 11 in the ideal tension state.

Further, the rollers 41*a* to 41*d* shaft-supported rotatably about the roller shaft portion 48*a* at an upper end portion of the connecting member 43*a* mounted in the upper side contact the inner peripheral surface of the intermediary transfer belt 11. Further, the rollers 42*a* to 42*d* shaft-supported rotatably about the roller shaft portion 48*b* at a lower end portion of the connecting member 43*b* mounted in the lower side contact the inner peripheral surface of the intermediary transfer belt 11.

As a result, a compressive force always acts between the connecting member 43*a* and the connecting member 43*b*. Therefore, similarly as in the above-described embodiments, with the tension fluctuation of the intermediary transfer belt 11, the connecting members 43*a* and 43*b* are integrally changed in position in the vertical direction.

Further, outer diameters of the rollers 41*a* to 41*d* and 42*a* to 42*d* provided to the connecting members 43*a* and 43*b*, respectively are set so as to satisfy: (roller 41*a* outer diameter)>(roller 41*b* outer diameter)>(roller 41*c* outer diameter)>(roller 41*d* outer diameter) and (roller 42*a* outer diameter)>(roller 42*b* outer diameter)>(roller 42*c* outer diameter)>(roller 42*d* outer diameter).

That is, each of the rollers 41 and 42 is increased in outer diameter from both end portions toward a central portion. As a result, as described above with reference to FIG. 6, also in the case where the intermediary transfer belt 11 is deviated from each of the rollers 41 and 42 in the main scan direction (the widthwise direction of the intermediary transfer belt 11), each of the rollers 41 and 42 does not apply a load to the intermediary transfer belt 11 by the presence of the tapered shape thereof. Further, with the rotation operation of the intermediary transfer belt 11, along the tapered shape of each of the rollers 41 and 42, the intermediary transfer belt 11 can be moved and restored to a normal position thereof. That is, it becomes possible to effect automatic center alignment.

Further, in this embodiment, outer diameters of the rollers 41 (41*a* to 41*d*) and 42 (42*a* to 42*d*) were set so as to satisfy: (roller 41*a* outer diameter)>(roller 41*b* outer diameter)>(roller 41*c* outer diameter)>(roller 41*d* outer diameter) and (roller 42*a* outer diameter)>(roller 42*b* outer diameter)>(roller 42*c* outer diameter)>(roller 42*d* outer diameter). However, the outer diameter relationship may only be required that the outer diameter at axial direction end portion is not larger than that at the axial direction central portion and thus is not necessarily limited to the above relationships.

As the rollers 41 and 42 which receive the tension of the intermediary transfer belt 11, the plurality of the rollers 41*a* to 41*d* and the plurality of the rollers 42*a* to 42*d* are juxtaposed, respectively. As a result, a force applied from the intermediary transfer belt 11 to the shaft supporting point of each of the roller shaft portions 48*a* and 48*b* of the rollers 41 and 42 can be dispersed. As a result, it becomes possible to downsize and weight-reduce the tension detecting unit 19 while suppressing flexure of the rollers 41 and 42 and deformation of the roller shaft portions 48*a* and 48*b* or the shaft-supporting portions for supporting the roller shaft portions 48*a* and 48*b* of the connecting members 43*a* and 43*b*.

Also in this embodiment, similarly as in the above-described embodiments, in either case of when the rotational speed of the secondary transfer roller 20 is higher and lower than the rotational speed of the driving roller, a slight tension fluctuation of the intermediary transfer belt 11 can be detected by the tension detecting unit 19 with high sensitivity and high accuracy. Further, on the basis of its detection result of the tension detecting unit 19, the rotational speed of the secondary transfer roller 20 is changed and corrected by controlling the driving motor 29 by the controller 27. As a result, it is possible to eliminate the tension non-uniformity state of the intermediary transfer belt 11 and thus the image forming apparatus with less color misregistration and less transfer deviation can be provided.

Further, in this embodiment, each of the rollers 41 and 42 of the tension detecting unit 19 is divided into the plurality of rollers and is disposed. As a result, the weight reduction of the tension detecting unit 19 can be realized and the slight tension fluctuation of the intermediary transfer belt 11 can be detected with higher sensitivity and higher accuracy, so that the image forming apparatus with less color misregistration and less transfer deviation can be provided.

Further, the connecting member 43 is divided into two connecting members 43*a* and 43*b*, so that latitude of disposition and a good assembling property can be realized and therefore it is possible to inexpensively provide the image forming apparatus with less color misregistration and less transfer deviation. Other constitutions are the same as those in the above-described embodiments, so that similar effects can be obtained.

Fourth Embodiment

With reference to FIG. 9, an image forming apparatus according to the Fourth Embodiment of the present invention will be described. Incidentally, constituent portions which are the same as those in the First to Third Embodiments are represented by the same reference numerals or symbols and will be omitted from description. In the above-described embodiments, the rollers 21, 22, 41 and 42 as the roller members rotatably shaft supported at the upper and lower end portions of the connecting members 23 and 43 as the movable members are contacted to the inner peripheral surface of the intermediary transfer belt 11 in a followable manner. In this embodiment, curved, sliding portions 57*a*2 and 57*b*2 as a contact portion to the inner peripheral surface of the intermediary transfer belt 11 are provided at upper and lower end portions of a connecting member 57 as the movable member.

As shown in FIG. 9, in the tension detecting unit 19, a connecting member 57 contacted to the inner peripheral surface of the intermediary transfer belt 11 simultaneously at two positions A and B located upstream and downstream of the secondary transfer roller 20 with respect to the rotational direction of the intermediary transfer belt 11.

Further, the connecting member 57 is constituted by connecting members 57*a* and 57*b* obtained by vertically dividing the connecting member 57, into two portions, as the movable member vertically changing in position depending on the tension change of the intermediary transfer belt 11 at the positions A and.

The lower connecting member 57*b* is mounted rotatably about a supporting shaft 59 to the tension detection lever 44 as the member to be detected which is provided rotatably about the supporting shaft 46 shaft-supported by the apparatus frame.

A positioning projection 57*b*1 provided on the lower connecting member 57*b* is inserted and engaged into a through hole 57*a*1 provided in the upper connecting member 57*a*. Then, the connecting members 57*a* and 57*b* are connected by inserting a fastening member 58 such as a bolt into an unshown through hole provided in each of the connecting members 57*a* and 57*b* and then by fastening the fastening member 58 with a nut or the like. As a result, the tension detection lever 44 is provided integrally with the connecting member 57 so as to be rotatably movable about the supporting shaft 46.

In this embodiment, the tension detecting unit 19 includes the connecting member 57*a* having the sliding portion 57*a*2 sliding in contact to the inner peripheral surface of the intermediary transfer belt 11 and the connecting member 57*b* having the sliding portion 57*b*2 sliding in contact to the inner peripheral surface of the intermediary transfer belt 11.

Further, similarly as in the above-described embodiments, when the rotational speed of the intermediary transfer belt 11 by the driving roller 12 and the rotational speed of the intermediary transfer belt 11 by the secondary transfer roller 20 are equal to each other, the tension detection lever 24 is configured so that a force applied to the intermediary transfer belt 11 by the connecting member 57 is smaller than a weight of the connecting member 57. That is, the tension detecting unit 19 is set so as to balance about the supporting shaft 46 at the substantially same position as the position of the intermediary transfer belt 11 in the ideal tension state.

Also in this embodiment, similarly as in the above-described embodiments, in either case of when the rotational speed of the secondary transfer roller 20 is higher and lower than the rotational speed of the driving roller, a slight tension fluctuation of the intermediary transfer belt 11 can be detected by the tension detecting unit 19 with high sensitivity and high accuracy. Further, on the basis of its detection result of the tension detecting unit 19, the rotational speed of the secondary transfer roller 20 is changed and corrected by controlling the driving motor 29 by the controller 27. As a result, it is possible to eliminate the tension non-uniformity state of the intermediary transfer belt 11 and thus the image forming apparatus with less color misregistration and less transfer deviation can be provided.

Further, in this embodiment, the sliding portions 57*a*2 and 57*b*2 in the tension detecting unit 19 as the contact portion which receives the tension of the intermediary transfer belt 11 are provided integrally with the connecting members 57*a* and 57*b*. As a result, further simplification and further downsizing of the tension detecting unit 19 can be realized and the slight tension fluctuation of the intermediary transfer belt 11 can be detected with higher sensitivity and higher accuracy, so that the image forming apparatus with less color misregistration and less transfer deviation can be provided in expensively.

Other constitutions are the same as those in the above-described embodiments, so that similar effects can be obtained.

Fifth Embodiment

With reference to (*a*) to (*c*) of FIG. 10, an image forming apparatus according to the Fifth Embodiment of the present invention will be described. Incidentally, constituent portions which are the same as those in the First to Fourth Embodiments are represented by the same reference numerals or symbols and will be omitted from description.

In this embodiment, in the tension detecting unit 19, rollers 61 and 62 of upper and lower connecting members 63*a* and 63*b* are simultaneously contacted to the inner peripheral surface of the intermediary transfer belt 11 at two positions A and B located upstream and downstream of the secondary transfer roller 20 with respect to the rotational direction of the intermediary transfer belt 11.

Further, the connecting members 63*a* and 63*b* obtained by vertically dividing the connecting member 43, into two portions, as a movable member vertically changing in position depending on the tension change of the intermediary transfer belt 11 at the positions A and B are swingable about a center shaft 65. At upper and lower end portions of the upper and lower connecting members 63*a* and 63*b*, the rollers 61 and 62 as a roller member contactable to the inner peripheral surface of the intermediary transfer belt 11 are rotatably shaft-supported.

In this embodiment, the tension detecting unit 19 includes the upper connecting member 63*a* for shaft-supporting a plurality of the rollers 61 and 62 rotatably about the roller shaft portion 48*a* at an upper end portion. Further, the tension detecting unit 19 includes the lower connecting member 63*b* for shaft-supporting the plurality of rollers 61 and 62 rotatably about the roller shaft portion 48*b* at a lower end portion 48*b*.

Further, the tension detecting unit 19 includes the tension detection lever 44, similar to that described above with reference to FIG. 7, as the member to be detected which is changed in position in interrelation with the position change of the connecting member 63*b*.

The tension detection lever 44 is mounted rotatably about the supporting shaft 46 on the intermediary transfer member frame 45 mounted on the apparatus frame. This structure is the same as that described in the Third Embodiment with reference to FIGS. 7 and 8. As shown in FIG. 10, in the connecting member 63*b* mounted in the lower side, the supporting shaft 47 provided on the tension detection lever 44 is inserted into an unshown through hole provided in the connecting member 63*b*. Thus, the connecting member 63*b* is shaft-supported rotatably about the supporting shaft 47 by the tension detection lever 44.

As shown in (*a*) to (*c*) of FIG. 10, the upper connecting member 63*a* is disposed swingably, relative to the lower connecting member 63*b*, about the center shaft 65 as the rotation center in arrow directions indicated in (*b*) and (*c*) of FIG. 10.

At a lower portion in each of both sides of the upper connecting member 63*a*, a projection 63*a*1 is provided. Further, the connecting member 63*a* is swung about the center shaft 65 in the arrow directions indicated in (*b*) and (*c*) of FIG. 10, so that the projection 63*a*1 contacts the upper surface of the lower connecting member 63*b* and thus a swing angle of the connecting member 63*a* is regulated.

Further, similarly as in the above-described embodiments, when the rotational speed of the intermediary transfer belt 11 by the driving roller 12 and the rotational speed of the intermediary transfer belt 11 by the secondary transfer roller 20 are equal to each other, the tension detection lever 24 is configured so that a force applied to the intermediary transfer belt 11 by the connecting member 63 is smaller than a weight of the connecting member 63. That is, the tension detecting unit 19 is set so as to balance about the supporting shaft 46, which is the same as that shown in FIGS. 7 and 8, at the substantially same position as the position of the intermediary transfer belt 11 in the ideal tension state.

The secondary transfer opposite roller 13 and the primary transfer roller 4Y are located upstream and downstream, respectively, of the rollers 61 and 62 provided to the upper connecting member 63*a* with respect to the rotational direction of the intermediary transfer belt 11. Further, inclination of the rollers 61 and 62 can be automatically corrected with respect to alignment (inclination of each roller) between the secondary transfer opposite roller 13 and the primary transfer roller 4Y.

That is, the upper connecting member 63*a* is swung about the center shaft 65 relative to the lower connecting member 63*b*. As a result, the inclination of the rollers 61 and 62 can be automatically corrected.

Thus, it becomes possible to suppress local urging of the intermediary transfer belt 11 and a lateral belt shifting force which are generated due to mutual alignment deviation of each of the rollers with respect to the intermediary transfer belt 11.

Further, in this embodiment, as shown in FIG. 10, the roller 62 provided at each of the both end portions of the connecting members 63*a* and 63*b* has the tapered shape at the axial direction end portion, so that it is possible to alleviate local urging concentration on the intermediary transfer belt 11 and thus durability of the intermediary transfer belt 11 can be improved.

Also in this embodiment, similarly as in the above-described embodiments, in either case of when the rotational speed of the secondary transfer roller 20 is higher and lower than the rotational speed of the driving roller, a slight tension fluctuation of the intermediary transfer belt 11 can be detected by the tension detecting unit 19 with high sensitivity and high accuracy. Further, on the basis of its detection result of the tension detecting unit 19, the rotational speed of the secondary transfer roller 20 is changed and corrected by controlling the driving motor 29 by the controller 27. As a result, it is possible to eliminate the tension non-uniformity state of the intermediary transfer belt 11 and thus the image forming apparatus with less color misregistration and less transfer deviation can be provided.

Further, in this embodiment, each of the rollers 61 and 62 of the tension detecting unit 19 is divided into the plurality of rollers and is disposed. As a result, the weight reduction of the tension detecting unit 19 can be realized and the slight tension fluctuation of the intermediary transfer belt 11 can be detected with higher sensitivity and higher accuracy, so that the image forming apparatus with less color misregistration and less transfer deviation can be provided inexpensively.

Further, the upper connecting member 63*a* was made swingable about the center shaft 65 relative to the lower connecting member 63*b*. As a result, damage on the intermediary transfer belt 11 due to the local urging against the intermediary transfer belt 11 generated by the alignment deviation between the respective rollers with respect to the intermediary transfer belt 11 is suppressed.

Further, a shifting force in the main scan direction (widthwise direction) of the intermediary transfer belt 11 is suppressed. Further, the slight tension fluctuation of the intermediary transfer belt 11 is detectable with high sensitivity and high accuracy. As a result, it is possible to provide the image forming apparatus with less color misregistration, less transfer deviation and high durability. Other constitutions are the same as those in the above-described embodiments, so that similar effects can be obtained.

Sixth Embodiment

With reference to FIG. 11, an image forming apparatus according to the Sixth Embodiment of the present invention will be described. Incidentally, constituent portions which are the same as those in the First to Fifth Embodiments are represented by the same reference numerals or symbols and will be omitted from description.

In this embodiment, the outer surface of the secondary transfer roller 20 for driving the intermediary transfer belt 11 in contact to the outer peripheral surface of the intermediary transfer belt 11 is coated with a resin tube 55, and a cleaning blade 56 is contacted to the surface of the resin tube 55.

A structure of the secondary transfer roller 20 in this embodiment will be described with reference to FIG. 11. The secondary transfer roller 20 includes a core metal 51 of stainless steel (SUS) at its center. The secondary transfer roller 20 includes, on the outer surface of the core metal 51, a primer layer 52, a layer 53 of foam NBR (nitrile-butadiene rubber), a primer layer 54 and the resin tube 55. The primer layers 52 and 54 are formed of an electroconductive adhesive.

The resin tube 55 as the outermost layer was formed of polyimide in a thickness of 50 μm and was about 0.3 μm in Rz (surface roughness), 18 mm in outer diameter, 65 degrees in hardness (Asker-C hardness under a load of 9.8 N (1000 gf)) and $1\times10^7$ Ω in electric resistance.

As the material of the resin tube 55 as the outermost surface layer of the secondary transfer roller 20 in this embodiment, polyimide was used. In place of polyimide, it is also possible to use polyvinylidene fluoride (PVDF) polycarbonate, polyethylene, polypropylene, polyamide, polysulfone, polyarylate, polyethylene terephthlate and polyether sulfone. Further, another resin material such as thermoplastic polyimide may also be used. In addition, the secondary transfer roller 20 may be prepared by forming a curable layer of the resin such as acrylic resin or an elastic layer of a solid rubber or the like on the surface layer of the above resin materials.

Further, as described above, the secondary transfer roller 20 in this embodiment is the roller prepared by coating the polyimide resin tube 55 and therefore a high frictional force is generated between itself and the intermediary transfer belt 11 formed of the resin material. This is because the resin materials for the secondary transfer roller 20 and the intermediary transfer belt 11 mutually have high smoothness to increase a true contact area at the secondary transfer nip T2 and therefore a depositing force due to the Van der Waals force or the like is increased. In this embodiment, a coefficient of static friction between the surface of the secondary transfer roller 20 and the surface of the intermediary transfer belt 11 in this embodiment was 0.6 as measured in accordance with JIS-K 7125.

In such a case, a tangential force fluctuation at the secondary transfer nip T2 also becomes large, so that the tension fluctuation of the intermediary transfer belt 11 is increased. Further, also in the case where the surface of the secondary transfer roller 20 is coated and in the case where the solid rubber roller is used, the tangential force at the secondary transfer nip T2 is similarly increased.

Further, the secondary transfer roller 20 in this embodiment has the smooth surface and therefore the cleaning blade 56 of the elastic member can be provided in contact to the surface of the secondary transfer roller 20.

That is, on the intermediary transfer belt 11, the toner image with an area larger than the area of the recording material 10 is formed. Then, the toner image is transferred onto the entire surface of the recording material 10 at the secondary transfer portion. Also in such a case, in a region outside the region of the recording material 10, the toner deposited on the secondary transfer roller 20 can be collected by the cleaning blade 56 with reliability. For this reason, borderless printing can be effected. Here, the borderless printing refers to printing in which an operation in a borderless printing mode for forming the toner image on the recording material ranging to edges of the recording material by secondary-transferring the toner image, larger in size than the recording material, from the intermediary transfer belt 11 onto the recording material is performed.

In this embodiment, as the cleaning blade 56, urethane rubber was employed, and the cleaning blade 56 was constituted so as to be urged against the secondary transfer roller 20 by an unshown urging member. However, the cleaning blade 56 is not limited thereto but may also be formed of another material used for the cleaning member for the purpose of removing the toner or may also have another constitution for that purpose.

In the case where the cleaning blade 56 is contacted to the secondary transfer roller 20 as described above, due to the friction fluctuation between the secondary transfer roller 20 and the cleaning blade 56, the speed fluctuation of the secondary transfer roller 20 can be generated.

Also in this embodiment, the slight tension fluctuation generated due to the difference between the rotational speed of the intermediary transfer belt 11 driven by the secondary transfer roller 20 and the rotational speed of the intermediary transfer belt 11 driven by the driving roller 12 is detectable.

Then, on the basis of the detection result of the tension detecting unit 19, the feed-back control is effected, so that the driving motor 29 is controlled by the controller 27 to change and correct the rotational speed of the secondary transfer roller 20. As a result, it becomes possible to suppress the tension fluctuation of the intermediary transfer belt 11 and at the same time to suppress the speed fluctuation of the intermediary transfer belt 11 caused by the tension correction. As a result, it is possible to provide the image forming apparatus with less color misregistration and less transfer deviation or the like.

Further, similarly, also in the case where the secondary transfer roller 20 coated with the polyimide resin tube 55 is used and the cleaning blade 56 is contacted to the secondary transfer roller 20 as described above, the tension fluctuation of the intermediary transfer belt 11 is suppressed. At the same time, the speed fluctuation of the intermediary transfer belt 11 caused by the tension correction can be suppressed, so that it becomes possible to provide an image forming apparatus capable of effecting the borderless printing with less color misregistration and with less transfer deviation or the like.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 152573/2011 filed Jul. 11, 2011, which is hereby incorporated by reference.

What is claimed is:

1. An image forming apparatus comprising:

an image bearing member for bearing a toner image;

a rotatable endless belt;

a first driving member for rotationally driving said endless belt and in contact with an inner peripheral surface of said endless belt;

a second driving member for rotationally driving said endless belt and in contact with an outer peripheral surface of said endless belt, wherein said second driving member is provided at a position where it does not oppose said first driving member via said endless belt; and a tension detecting unit for detecting a state of tension of said endless belt;

wherein said tension detecting unit comprises:

a movable device, in contact with said endless belt in a first region from downstream of said second driving member to upstream of said first driving member and in a second region from downstream of said first driving member to upstream of said second driving member with respect to a rotational direction of said endless belt, and capable of moving its position depending on the tension of said endless belt in the first and second regions;

a member to be detected capable of changing its position in interrelation with the movement of said movable device; and a detecting device for detecting said member to be detected.

2. An apparatus according to claim 1, wherein when a rotational speed of said endless belt driven by said first driving member and a rotational speed of said endless belt driven by said second driving member is the same, a force applied from said movable device to said endless belt is smaller than a weight of said movable device.

3. An apparatus according to claim 1, wherein said movable device comprises:

a first contact member in contact with said endless belt in the first region;

a second contact member in contact with said endless belt in the second region; and a connecting member for connecting said first contact member and said second contact member.

4. An apparatus according to claim 3, wherein each of said first contact member and said second contact member is a rotatable roller.

5. An apparatus according to claim 3, wherein said member to be detected is rotatable about its rotation shaft and includes a connecting portion connected to said connecting member at one end portion thereof and an opposing surface, at the other end portion thereof, where said member to be detected opposes said detecting device.

6. An apparatus according to claim 5, wherein a length from the rotation shaft to the connecting portion is shorter than a length from the rotation shaft to said detecting device.

7. An apparatus according to claim 1, further comprising a controller for controlling said second driving member, wherein said controller increases a rotational speed of said second driving member when said movable device is pushed down toward the inner peripheral surface of said endless belt by said endless belt in the first region.

8. An apparatus according to claim 1, further comprising a controller for controlling said second driving member, wherein said controller decreases a rotational speed of said second driving member when said endless belt is pushed upward by said movable device in the second region.

9. An apparatus according to claim 1, further comprising a tension roller, capable of applying the tension to said endless belt in contact to the inner peripheral surface of said endless belt, to be in contact with and separated from said endless belt, wherein said controller controls a position of said tension roller depending on a detection result of said detecting device when a state of said tension roller is changed from a separation state to a contact state.

10. An apparatus according to claim 1, wherein said endless belt is an intermediary transfer belt, and wherein said second driving member is a transfer member for transferring the toner image from the intermediary transfer belt onto a recording material.

11. An apparatus according to claim 1, wherein said movable device comprises:

a first contact member in contact with said endless belt in the first region;

a second contact member in contact with said endless belt in the second region;

a first connecting member to be connected to said first contact member; and a connecting member to be connected to said second contact member, wherein each of said first connecting member and said second connecting member is slidable.

12. An apparatus according to claim 11, wherein each of said first contact member and said second contact member is divided into a plurality of rotatable rollers with respect to its widthwise direction perpendicular to the rotational direction of said endless belt.

13. An apparatus according to claim 11, wherein each of said first contact member and said second contact member is a sliding portion slidable in contact with the inner peripheral surface of said endless belt.

14. An apparatus according to claim 1, wherein said detecting device is a distance measuring sensor, including a light emitting portion for emitting light onto a reflection surface and a light receiving portion for receiving the light from the reflection surface, for detecting a distance to the reflection surface.

15. An apparatus according to claim 1, wherein the first driving member is a roller rotatable by a driving source.

16. An apparatus according to claim 1, wherein the second driving member is a roller rotatable by a driving source.

* * * * *